US008492637B2

(12) United States Patent
Miyajima

(10) Patent No.: US 8,492,637 B2
(45) Date of Patent: Jul. 23, 2013

(54) INFORMATION PROCESSING APPARATUS, MUSICAL COMPOSITION SECTION EXTRACTING METHOD, AND PROGRAM

(75) Inventor: Yasushi Miyajima, Kanagawa (JP)

(73) Assignee: Sony Corporation, Tokyo (JP)

( * ) Notice: Subject to any disclaimer, the term of this patent is extended or adjusted under 35 U.S.C. 154(b) by 91 days.

(21) Appl. No.: 13/288,335

(22) Filed: Nov. 3, 2011

(65) Prior Publication Data

US 2012/0118127 A1 May 17, 2012

(30) Foreign Application Priority Data

Nov. 12, 2010 (JP) ..... P2010-253914

(51) Int. Cl.
*G10H 1/38* (2006.01)

(52) U.S. Cl.
USPC ..... 84/613; 84/609; 84/611; 84/612; 84/649; 84/651; 84/652

(58) Field of Classification Search
None
See application file for complete search history.

(56) References Cited

U.S. PATENT DOCUMENTS

| | | | | |
|---|---|---|---|---|
| 6,031,171 | A * | 2/2000 | Tohgi et al. | 84/470 R |
| 7,075,000 | B2 * | 7/2006 | Gang et al. | 84/600 |
| 2005/0211077 | A1 | 9/2005 | Kobayashi | |
| 2007/0255739 | A1 | 11/2007 | Miyajima et al. | |
| 2008/0156177 | A1 * | 7/2008 | Iketani et al. | 84/609 |
| 2009/0019995 | A1 | 1/2009 | Miyajima | |
| 2009/0064851 | A1 * | 3/2009 | Morris et al. | 84/637 |
| 2009/0093896 | A1 | 4/2009 | Kobayashi | |
| 2009/0145284 | A1 * | 6/2009 | Saijo | 84/609 |
| 2009/0151547 | A1 | 6/2009 | Kobayashi | |
| 2009/0287323 | A1 | 11/2009 | Kobayashi | |
| 2010/0170382 | A1 | 7/2010 | Kobayashi | |
| 2010/0322042 | A1 * | 12/2010 | Serletic et al. | 369/1 |
| 2012/0118127 | A1 * | 5/2012 | Miyajima | 84/612 |
| 2012/0180618 | A1 * | 7/2012 | Rutledge et al. | 84/610 |
| 2012/0297958 | A1 * | 11/2012 | Rassool et al. | 84/609 |
| 2012/0312145 | A1 * | 12/2012 | Kellett et al. | 84/613 |
| 2013/0025434 | A1 * | 1/2013 | Gannon | 84/613 |
| 2013/0025437 | A1 * | 1/2013 | Serletic et al. | 84/634 |

FOREIGN PATENT DOCUMENTS

| | | |
|---|---|---|
| JP | 2005-275068 | 10/2005 |
| JP | 2007-156434 | 6/2007 |
| JP | 2007-183417 | 7/2007 |
| JP | 2007-248895 | 9/2007 |
| JP | 2008-164932 | 7/2008 |
| JP | 2009-92791 | 4/2009 |
| JP | 2010-134231 | 6/2010 |

* cited by examiner

*Primary Examiner* — Marlon Fletcher
(74) *Attorney, Agent, or Firm* — Sherr & Jiang, PLLC

(57) ABSTRACT

An information processing apparatus includes: a musical composition section extracting unit which extracts musical composition sections with tempos which are close to a preset reference tempo based on tempo information indicating a tempo of each section constituting musical compositions; a harmonization level calculating unit which calculates a harmonization degree for a pair of musical composition sections extracted by the musical composition section extracting unit, based on chord progression information indicating chord progression of each section constituting musical compositions; and a harmonization section extracting unit which extracts a pair of sections with a high harmonization degree for the musical compositions calculated by the harmonization level calculating unit from among sections extracted by the musical composition section extracting unit, wherein the harmonization level calculating unit weights the harmonization degree for the musical compositions such that a large value is set to the harmonization degree between musical compositions with a predetermined relationship.

15 Claims, 15 Drawing Sheets

FIG. 7

| INDEX | MUSIC ID | START POSITION (BAR) | END POSITION (BAR) | SECTION TEMPO | SENSE OF BEAT |
|---|---|---|---|---|---|
| 0 | 1 | 1 | 17 | 135.562 | 4 |
| 1 | 2 | 1 | 5 | 142.245 | 4 |
| 2 | 2 | 13 | 19 | 143.504 | 4 |
| 3 | 3 | 5 | 12 | 145.258 | 4 |
| 4 | 4 | 1 | 9 | 149.116 (74.558 * 2) | 8 |

FIG. 9

| INDEX | INDEX IN TARGET MUSIC COMPOSITION SECTION LIST | START POSITION (BAR) | END POSITION (BAR) | MATCHING LEVEL | MODULATION FREQUENCY | WEIGHTING COEFFICIENT |
|---|---|---|---|---|---|---|
| 0 | 2 | 14 | 17 | 1.0 | 0 | 1.0 |
| 1 | 3 | 7 | 10 | 0.8 | +2 | 1.5 |
| 2 | 4 | 1 | 4 | 1.0 | −1 | −1.0 |

FIG. 15

| MELODY TYPE | WEIGHTING COEFFICIENT |
|---|---|
| INTRODUCTION | 1.5 |
| MELODY A | 1.0 |
| MELODY B | 0.8 |
| HOOK LINE | 2.0 |
| MAIN HOOK LINE | 2.5 |
| SOLO | 1.5 |
| BRIDGE | 1.2 |
| ENDING | 1.3 |

FIG. 16

| TYPE OF INSTRUMENT | WEIGHTING COEFFICIENT |
|---|---|
| MALE VOCAL | 1.0 |
| FEMALE VOCAL | 1.2 |
| PIANO | 1.1 |
| GUITAR | 2.0 |
| DRUM | 1.5 |
| BASS GUITAR | 1.3 |
| STRINGS | 0.7 |
| WINDS | 0.8 |

| WELL-MATCHED SECTION | START POINT | END POINT | WEIGHTING COEFFICIENT |
|---|---|---|---|
| A | IN THE COURSE OF LYRIC | IN THE COURSE OF LYRIC | 0.64 |
| B | CAESURA | IN THE COURSE OF LYRIC | 0.8 |
| C | CAESURA | CAESURA | 1.0 |

INFORMATION PROCESSING APPARATUS, MUSICAL COMPOSITION SECTION EXTRACTING METHOD, AND PROGRAM

BACKGROUND

The present disclosure relates to an information processing apparatus, a musical composition section extracting method, and a program.

There is a method in which favorite parts of musical composition sections are extracted from a plurality of musical compositions prepared in advance and the extracted musical composition sections are joined with each other. This method is called remixing. In the scenes such as club events and the like, a plurality of musical compositions are prepared in a reproducible state, and remixing is realized by manually controlling reproduction timing and volume of each musical composition. In addition, there are more people who personally enjoy remixing. For example, more people remix musical compositions to match the rhythm of jogging to create an original musical composition to be listened to while jogging.

However, proficiency is necessary for joining musical compositions in a seamless manner without degrading the qualities of music and rhythm at the connections between the musical compositions. For this reason, it is difficult for many users without proficiency to casually enjoy musical compositions which have been remixed with no sense of discomfort at the connections between musical compositions. In view of such circumstances, an apparatus capable of automatically connecting musical compositions in a seamless manner has been studied and developed. One of the achievements is a music editing apparatus disclosed in Japanese Unexamined Patent Application Publication No. 2008-164932. This music editing apparatus has the functions of matching the tempo and the key of a musical composition as a remixing target with a predetermined tempo and key and controlling the reproduction timing such that the bar top positions are synchronized. With such a function, it is possible to connect musical compositions in a seamless manner.

SUMMARY

However, the music editing apparatus disclosed in Japanese Unexamined Patent Application Publication No. 2008-164932 outputs musical composition candidates, which can be remixed in a seamless manner, based on information in the musical scores regardless of the categories and the tones of the musical compositions to be remixed. Therefore, if the musical compositions output from the music editing apparatus are randomly joined, a classical musical composition may be remixed with a rock musical composition, or a musical composition with a sad tone may be remixed with a musical composition with an upbeat tone, for example. That is, the musical compositions in combination, from which a user has a sense of discomfort at the connections while the tempos and keys thereof fit in therewith, are output as candidates. In order to perform remixing with no sense of discomfort at the connections, an operation of selecting and joining musical compositions from which the user does not receive an intentional sense of discomfort is performed.

It is desirable to provide a new and improved information processing apparatus, a musical composition section extracting method, and a program which can automatically extract combinations of musical composition sections from which it is difficult for a user to have a sense of discomfort at the time of remixing.

According to an embodiment of the present disclosure, there is provided an information processing apparatus including: a musical composition section extracting unit which extracts musical composition sections with tempos which are close to a preset reference tempo based on tempo information indicating a tempo of each section constituting the musical compositions; a harmonization level calculating unit which calculates the harmonization degree for a pair of musical composition sections extracted by the musical composition section extracting unit, based on chord progression information indicating chord progression of each section constituting the musical compositions; and a harmonization section extracting unit which extracts a pair of sections with a high harmonization degree for the musical compositions calculated by the harmonization level calculating unit from among sections extracted by the musical composition section extracting unit, wherein the harmonization level calculating unit weights the harmonization degree for the musical compositions such that a large value is set to the harmonization degree between musical compositions with a predetermined relationship.

In addition, the processing may further include a tempo setting unit which sets the reference tempo. In such a case, the tempo setting unit changes the reference tempo based on predetermined time-series data.

In addition, the information processing apparatus may further include: a rhythm detection unit which detects a user's exercise rhythm; and a tempo setting unit which sets the reference tempo. In such a case, the tempo setting unit changes the reference tempo so as to match the user's exercise rhythm detected by the rhythm detection unit.

In addition, the harmonization level calculating unit may weight the harmonization degrees of musical compositions such that a large value is set to the harmonization levels between musical compositions to both of which metadata indicating one or a plurality of preset mood, categories, melody structures, and instrument types of the musical compositions has been added.

In addition, the harmonization section extracting unit may extract a pair of sections, in which phrases of lyrics are not interrupted at ends, with priority from among the sections extracted by the musical composition section extracting unit.

In addition, the information processing apparatus may further include: a tempo adjustment unit which adjusts tempos of two musical compositions corresponding to a pair of sections extracted by the harmonization section extracting unit to the reference tempo; and a musical composition reproducing unit which makes beat positions synchronize with each other after tempo adjustment by the tempo adjustment unit and reproduces the two musical compositions corresponding to the pair of sections extracted by the harmonization section extracting unit simultaneously.

In addition, the harmonization level calculating unit may calculate the harmonization level of musical compositions based on chord progression information of absolute chord and chord progression information of relative chord. Moreover, the harmonization section extracting unit may extract a pair of sections with a high harmonization degree for the musical compositions calculated by the harmonization level calculating unit based on the chord progression information of the relative chord or a pair of sections with a high harmonization degree for the musical compositions calculated by the harmonization level calculating unit based on the chord progression information of the absolute chord. In addition, the information processing apparatus may further include a modulation step calculation unit which calculates modulation steps by which keys of two musical compositions corresponding to the pair of sections extracted by the harmonization section extracting unit are made to match. In such a case, the musical composition reproducing unit reproduces a musical composition which has been modulated by the modulation steps calculated by the modulation step calculating unit.

In addition, the musical composition reproducing unit may cross-fade and reproduce the two musical compositions.

In addition, the music reproducing unit may set the time of cross-fade to be shorter when the harmonization degree for the musical compositions calculated by the harmonization level calculating unit is lower.

In addition, the musical composition section extracting unit may further extract a section of an eight-beat musical composition with a tempo which corresponds to about ½ of the reference tempo and a section of a sixteen-beat musical composition with a tempo which corresponds to about ½ or ¼ of the reference tempo.

According to another embodiment of the present disclosure, there is provided an information processing apparatus including: a musical composition section extracting unit which extracts musical composition sections with tempos which are close to a predetermined reference tempo, which temporally changes, based on tempo information indicating a tempo of each section constituting the musical compositions; a harmonization level calculating unit which calculates a harmonization degree for a pair of musical composition sections extracted by the musical composition section extracting unit, based on chord progression information indicating chord progression of each section constituting musical compositions; and a harmonization section extracting unit which extracts a pair of sections with a high harmonization degree for the musical compositions calculated by the harmonization level calculating unit from among sections extracted by the musical composition section extracting unit.

According to still another embodiment of the present disclosure, there is provided a musical composition section extracting method including: extracting music sections with tempos which are close to a preset reference tempo based on tempo information indicating a tempo of each section constituting musical compositions; calculating a harmonization degree for a pair of musical composition sections extracted in the extracting, based on chord progression information indicating chord progression of each section constituting musical compositions; and extracting a pair of sections with a high harmonization degree for the musical compositions calculated in the calculating from among sections extracted in the previous extracting, wherein in the calculating, the harmonization degree for the musical compositions is weighted such that a large value is set to the harmonization degree between musical compositions with a predetermined relationship.

According to still another embodiment of the present disclosure, there is provided a musical composition section extracting method including: extracting musical composition sections with tempos which are close to a predetermined reference tempo, which temporally changes, based on tempo information indicating a tempo of each section constituting musical compositions; calculating a harmonization degree for a pair of musical composition sections extracted in the extracting, based on chord progression information indicating chord progression of each section constituting musical compositions; and extracting a pair of sections with a high harmonization degree for the musical compositions calculated in the calculating from among sections extracted in the previous extracting.

According to still another embodiment of the present disclosure, there is provided a program which causes a computer to realize: a musical composition section extracting function which extracts musical composition sections with tempos which are close to a preset reference tempo based on tempo information indicating a tempo of each section constituting musical compositions; a harmonization level calculating function which calculates a harmonization degree for a pair of musical composition sections extracted by the musical composition section extracting function, based on chord progression information indicating chord progression of each section constituting musical compositions; and a harmonization section extracting function which extracts a pair of sections with a high harmonization degree for the musical compositions calculated by the harmonization level calculating function from among sections extracted by the musical composition section extracting function, wherein the harmonization level calculating function weights the harmonization degree for the musical compositions such that a large value is set to the harmonization degree between musical compositions with a predetermined relationship.

According to still another embodiment of the present disclosure, there is provided a program which causes a computer to realize: a musical composition section extracting function which extracts musical composition sections with tempos which are close to a predetermined reference tempo, which temporally changes, based on tempo information indicating a tempo of each section constituting musical compositions; a harmonization level calculating function which calculates a harmonization degree of a pair of musical composition sections extracted by the musical composition section extracting function, based on chord progression information indicating chord progression of each section constituting musical compositions; and a harmonization section extracting function which extracts a pair of sections with a high harmonization degree for the musical compositions calculated by the harmonization level calculating function from among sections extracted by the musical composition section extracting function.

According to the present disclosure, it is possible to automatically extract combinations of musical composition sections from which it is difficult for a user to have a sense of discomfort at the time of remix as described above.

BRIEF DESCRIPTION OF THE DRAWINGS

FIG. 7 is an explanatory diagram for illustrating a configuration of a target musical composition section list according to the embodiment;

FIG. 9 is an explanatory diagram for illustrating a configuration of a harmonization section list according to the embodiment;

FIG. 15 is an explanatory diagram for illustrating an example of weighting used in a harmonization section extracting method according to the embodiment;

FIG. 16 is an explanatory diagram for illustrating an example of weighting used in a harmonization section extracting method according to the embodiment;

DETAILED DESCRIPTION OF EMBODIMENTS

Figure 1:
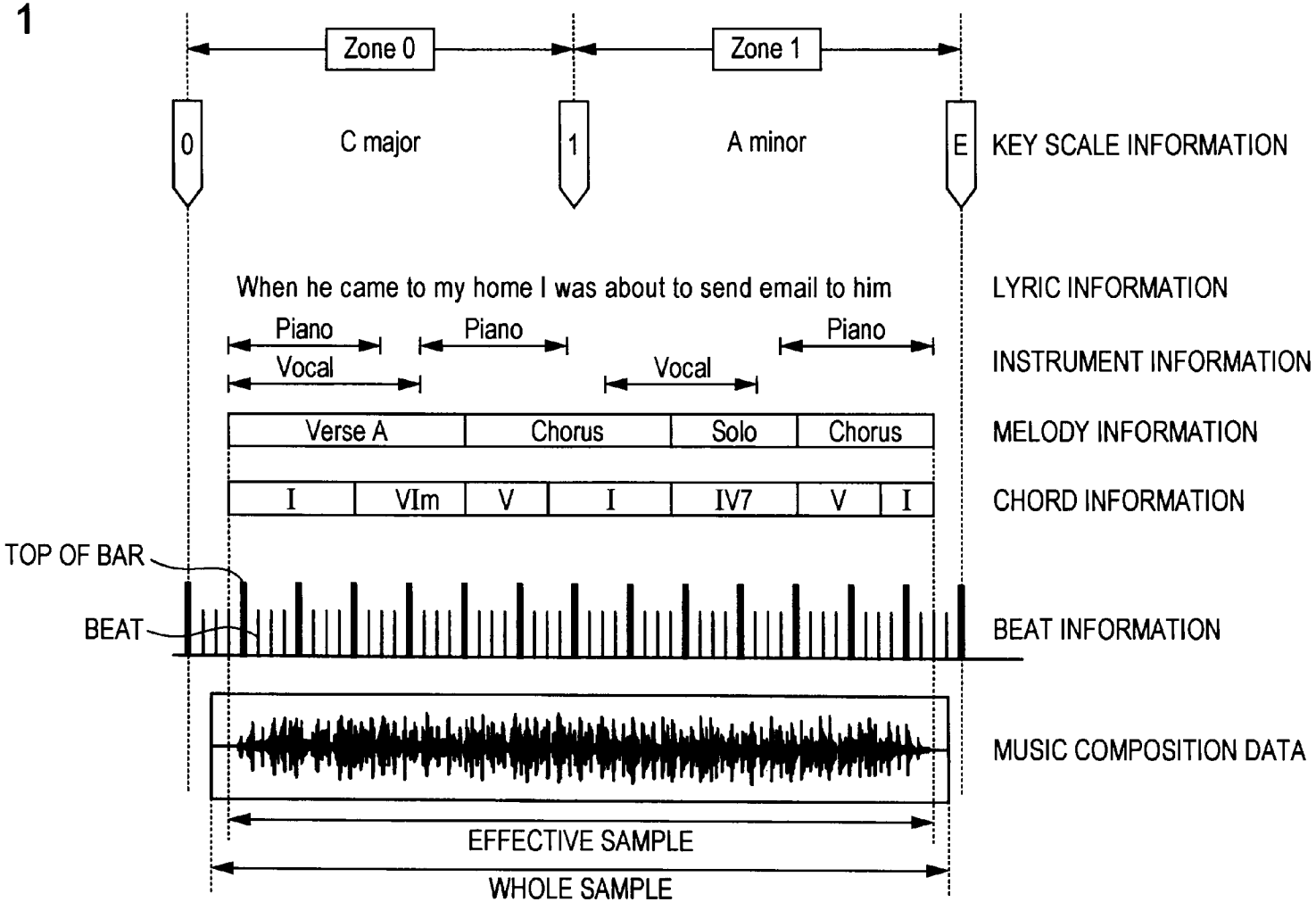
FIG. 1 is an explanatory diagram for illustrating a configuration of metadata used in a musical composition section extracting method according to an embodiment.

Hereinafter, detailed description will be given of a preferable exemplary embodiment with reference to the accompanying drawings. In addition, same reference numerals are added to components with substantially the same functional configurations in this specification and drawings, and the description thereof will not be repeated.

[Flow of Description]

Hereinafter, description will briefly be given of a flow of the description in relation to the following exemplary embodiment.

First, description will be given of a configuration of metadata used in a musical composition section extracting method according to the embodiment with reference to FIG. 1. Next, description will be given of a functional configuration of a musical composition reproducing apparatus 100 according to the embodiment with reference to FIG. 2. In addition, description will be given of a tempo adjustment method according to the embodiment with reference to FIGS. 3 and 4. Moreover, description will be given of a musical composition section extracting method according to the embodiment with reference to FIGS. 5 to 7.

Then, description will be given of a harmonization section extracting method according to the embodiment with reference to FIGS. 8 to 10. Subsequently, description will be given of a detailed functional configuration of a mixing and reproducing unit 105 configuring a musical composition reproducing apparatus 100 according to the embodiment with reference to FIG. 11. In addition, the description will be given of a mixing and reproducing method according to the embodiment with reference to FIGS. 12 and 13. Then, description will be given of overall operations of the musical composition reproducing apparatus 100 according to the embodiment with reference to FIG. 14.

Then, description will be given of a specific setting method of a weighting value used in a harmonization section extracting method according to the embodiment with reference to FIGS. 15 to 18. Next, description will be given of a hardware configuration of an information processing apparatus capable of realizing functions of musical composition reproducing apparatus 100 according to the embodiment with reference to FIG. 19. Finally, description will be given of the conclusions regarding the technical idea of the embodiment and actions and effects which can be obtained from the technical idea.

(Items to be Described)

1: Embodiment 1-1: Configuration of Metadata 1-2: Configuration of Musical composition Reproducing Apparatus 100

1-2-1: Overall Configuration 1-2-2: Functions of Parameter Setting Unit 102

1-2-3: Functions of Target Musical composition Section Extracting Unit 103

1-2-4: Functions of Harmonization Section Extracting Unit 104

1-2-5: Functions of Mixing and Reproducing Unit 105

1-2-6: Functions of Sequence Control Unit 108

2: Hardware Configuration Example

3: Conclusions

1: Embodiment

Description will be given of an embodiment. The embodiment relates to a technique for automatically creating musical compositions for enlivening a party, assisting a rhythmical exercise such as jogging or the like by remix. Particularly, the embodiment relates to a musical composition creating technique capable of automatically extracting musical composition sections suitable for remix and remixing the musical compositions without degrading the properties of music and rhythm. It is possible to reduce a user's sense of discomfort during reproduction at the connections between musical composition sections in the musical composition created in the remix (hereinafter, referred to as a remixed musical composition). Hereinafter, detailed description will be given of a technique according to the embodiment.

[1-1: Configuration of Metadata]

Description will be made of a configuration of metadata used in a musical composition creating technique according to the embodiment with reference to FIG. 1. FIG. 1 is an explanatory diagram for illustrating a configuration of metadata used in a musical composition creating technique according to the embodiment. This metadata is for being added to individual musical composition data. In addition, this metadata may be manually added to musical composition data or may be automatically added to musical composition data based on an analysis result of the musical composition data.

Japanese Unexamined Patent Application Publication Nos. 2007-248895 (extraction of beat positions and bar tops), 2005-275068 (extraction of music interval), 2007-156434 (extraction of melody information), 2009-092791 (extraction of music interval), 2007-183417 (extraction of chord progression), 2010-134231 (extraction of instrument information), and the like disclose techniques for automatically extracting metadata from musical composition data. It is possible to easily add metadata as shown in FIG. 1 to musical composition data by using such techniques.

As shown in FIG. 1, metadata includes key scale information, lyric information, instrument information, melody information, chord information, beat information, and the like, for example. However, a part of the lyric information, instrument information, melody information, and the like is omitted in some cases. In addition, metadata may include information such as the mood of the musical composition, the category to which the musical composition belongs, and the like.

The key scale information is information indicating keys and scales. For example, in FIG. 1, the key scale information of the musical composition section shown as Zone0 is C major while the key scale information of the musical composition section shown as Zone1 is A minor. In addition, Zone0 and Zone1 show musical composition sections in which keys and scales are not changed. Moreover, the key scale information includes information indicating change position of the keys and the scales.

The lyric information is text data indicating lyrics. In addition, the lyric information includes information indicating a start position and an end position of each character or each sentence of the lyrics. Moreover, the instrument information is information regarding used instruments (or voice). For example, instrument information (Piano) indicating a piano is added to a musical composition section including the sounds of the piano. In addition, instrument information (Vocal) indicating a voice is added to the musical composition section including a voice. The instrument information includes information indicating sound output start timing and sound output end timing for each instrument. As for the type of instruments which can be handled, various instruments such as the guitar, the drum, and the like are exemplified as well as the piano and vocal.

The chord information is the information indicating chord progression and a position of each chord. The beat information is information indicating positions of bars and beats (meter). The melody information is information indicating the melody structure. In addition, the musical composition section will be considered in units of beats in this embodiment. Accordingly, the start position and the end position of the musical composition section synchronize with the beat position indicated by the beat information. Now, the waveform shown in the lowest part in FIG. 1 shows a waveform of the musical composition data. In addition, a range in which musical composition data is actually recorded is a range shown as an effective sample from among the range shown as a whole sample in the waveform of this musical composition data.

Here, supplemental description will be given of the beat information, the chord information, and the melody information.

(Concerning Beat Information)

The beat information indicates positions of a beat at the top of each bar of the musical composition (hereinafter, referred to as a bar top) and beats other than the bar top. In FIG. 1, the positions of bar tops in the musical composition data are represented by long vertical lines shown on the left side of the words "Beat Information". In addition, the positions of beats other than the bar tops are represented by short vertical lines. The example of FIG. 1 shows a configuration of metadata regarding quadruple measure musical composition. Therefore, the bar tops appears at each four beats in this example. It is possible to obtain a tempo (average BPM (Beat Per Minute)) of a musical composition section with the use of the beat information based on the following equation (1). However, Bn represents the number of beats in the musical composition section, Fs represents a sampling rate of the musical composition data, and Sn represents the number of samples in the musical composition section, in the following equation (1).

$$\text{Average } BPM = \frac{Bn \times Fs}{Sn} \times 60 \tag{1}$$

(Chord Information)

The chord information indicates types of chords in the musical composition and musical composition sections corresponding to each chord. It is possible to easily extract a musical composition section corresponding to a certain chord by referring to this chord information. In addition, it is possible to extract a musical composition section corresponding to a certain chord on the basis of a beat position by using the chord information and the beat information in combination. In addition, the chord information may be notated by cord names (hereinafter, referred to as absolute chord notation) or may be notated by a relative position of root note of the chord with respect to the keynote of the scale (hereinafter, referred to as a relative chord notation).

In the case of the relative chord notation, each chord is represented as I, I♯ (or II♭), II, II♯ (or III♭), III, III♯ (or IV♭), IV, IV♯ (or V♭), V, V♯ (or VI♭), VI, VI♯ (or VII♭), VII, VII♯ (or I♭) based on the scale degree indicating the relative position between the keynote of the scale and the root note of the chord. On the other hand, in the case of absolute chord notation, each code is represented by a chord name such as C, E, or the like. In addition, first chord progression represented as C, F, G, Am in the absolute chord notation and second chord progression represented as E, A, B, C♯m can be represented in the same manner as I, I, V, V, VIm in the relative chord notation.

Figure 10:
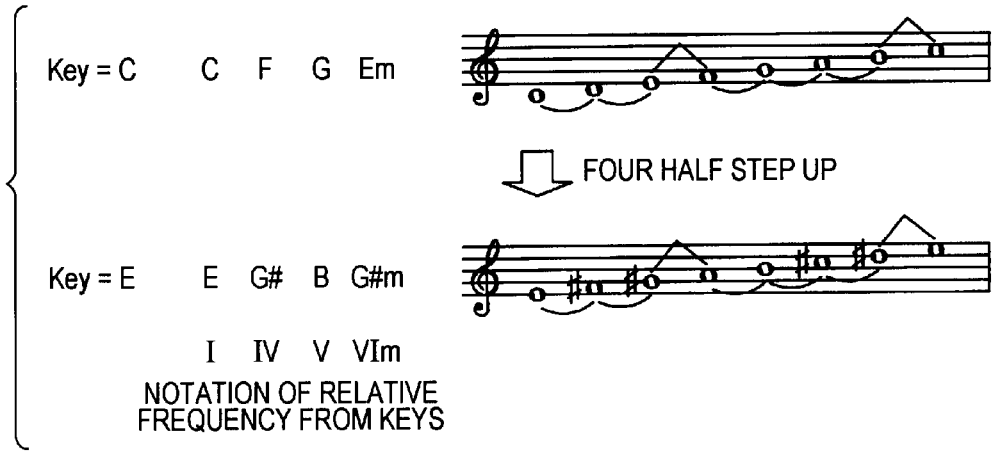
FIG. 10 is an explanatory diagram for illustrating absolute chord notation and relative chord notation for chord progression, and modulation.

That is, the first chord progression is the C major scale and synchronizes with the second chord progression if the music interval of each chord in the first chord progression is raised by four half steps (see FIG. 10). Similarly, the second chord progression is the E major scale and synchronizes with the first chord progression if the music interval of each chord in the second chord progression is lowered by four half steps. Such a relationship is obvious at a glance in the relative chord notation. For such a reason, it is preferable to employ the relative chord notation for the chord progression as shown in FIG. 1 when the relationship between musical compositions is analyzed based on the chord progression. Accordingly, the following description will be given on the assumption that the chord information is expressed in the relative chord notation.

(Concerning Melody Information)

The melody information indicates a musical composition section corresponding to an element (hereinafter, referred to as a melody block) of each melody in the musical composition. For example, types of melody blocks include introduction (Intro), melody A (Verse A), melody B (Verse B), hook line (Chorus), interlude (Interlude), solo (Solo), ending (Outro), and the like. As shown in FIG. 1, the melody information includes information of types of melody blocks and a musical composition section corresponding to each melody block. Therefore, it is possible to easily extract a musical composition section corresponding to a certain melody block by referring to the melody information.

The configuration of metadata to be added to musical composition data was described above. In addition, the beat information, the chord information, and the melody information included in metadata were described in detail.

[1-2: Configuration of Musical Composition Reproducing Apparatus 100]

Next, description will be given of a musical composition reproducing apparatus 100 capable of remixing a plurality of musical compositions in a seamless manner with the use of above metadata. This musical composition reproducing apparatus 100 is for reproducing remixed musical composition by extracting musical composition sections suitable for remix from among a plurality of musical compositions and joining the extracted musical composition sections in a seamless manner.

(1-2-1: Overall Configuration)

Figure 2:
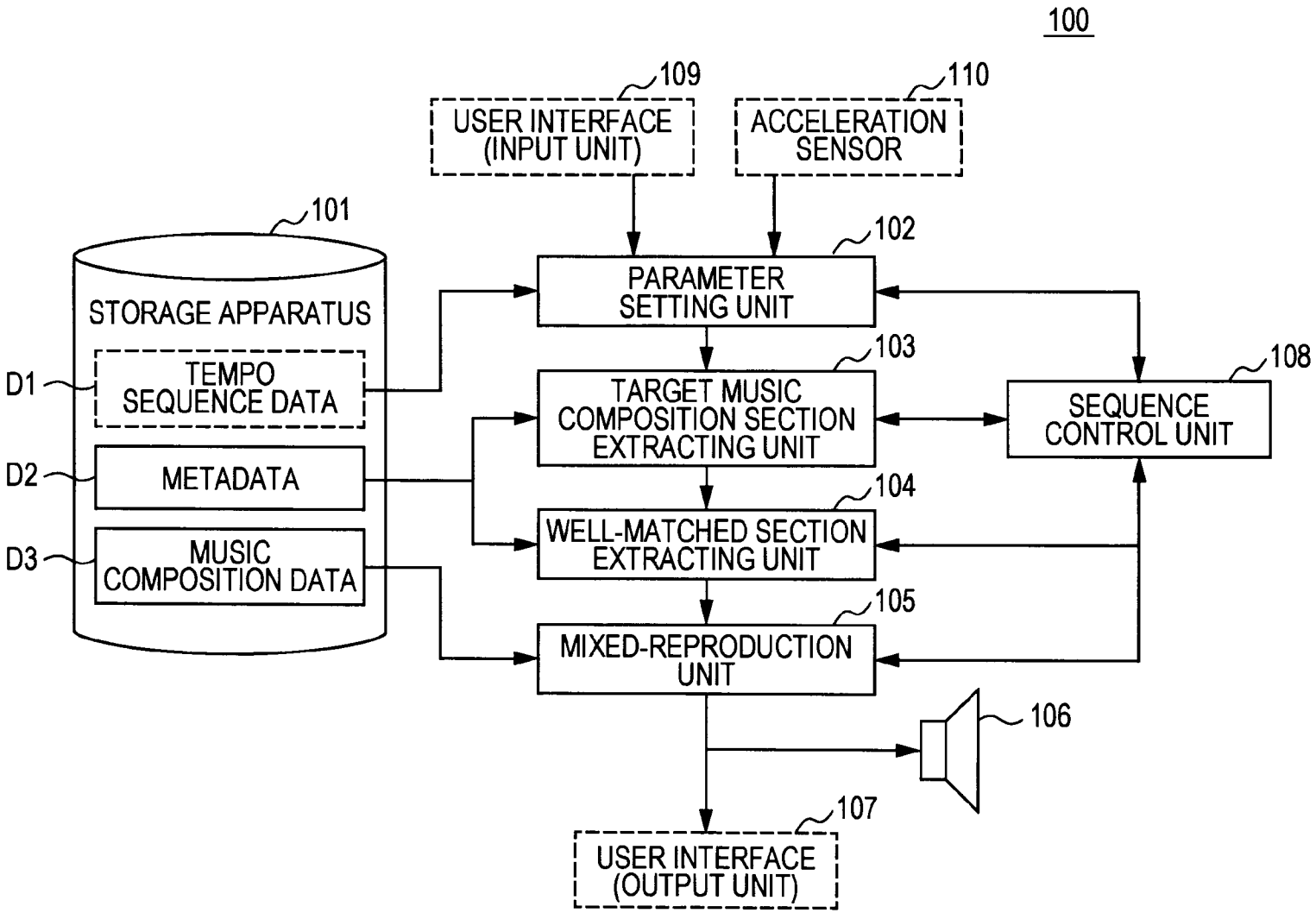
FIG. 2 is an explanatory diagram for illustrating a functional configuration of a music reproducing apparatus according to the embodiment.

First description will be given of an overall configuration of the musical composition reproducing apparatus 100 according to this embodiment with reference to FIG. 2. FIG. 2 is an explanatory diagram for illustrating a functional configuration of the musical composition reproducing apparatus 100 according to this embodiment.

As shown in FIG. 2, the musical composition reproducing apparatus 100 includes, a storage apparatus 101, a parameter setting unit 102, a target musical composition section extracting unit 103, a harmonization section extracting unit 104, a mixing and reproducing unit 105, a speaker 106, an output unit 107 (user interface), a sequence control unit 108, an input unit 109 (user interface), and an acceleration sensor 110. However, the storage unit 101 may be provided outside the musical composition reproducing apparatus 100. In such a case, the storage apparatus 101 is connected to the musical composition reproducing apparatus 100 via the Internet, WAN (Wide Area Network), LAN (Local Area Network), another communication line, or a connection cable.

The storage apparatus 101 stores tempo sequence data D1, metadata D2, and musical composition data D3. The tempo sequence data D1 is time-series data in which the tempo of the remixed musical composition finally output from the speaker 106 (hereinafter, referred to as a designated tempo) is described. Particularly, the tempo sequence data D1 is used to change the designated tempo in a predetermined pattern in accordance with the reproduction time of the remixed musical composition (see FIG. 4). When the designated tempo is not changed in the predetermined pattern, the tempo sequence data D1 may not be stored on the storage apparatus 101. However, the following description will be given on the assumption that the tempo sequence data D1 is stored on the storage apparatus 101.

The metadata D2 is metadata with the configuration which has already been described above with reference to FIG. 1. The metadata D2 is added to the musical composition data D3. In addition, the metadata D2 represents the attribute of the musical composition section configuring the musical composition data D3. The following description will be given on the assumption that the metadata D2 includes key scale information, lyric information, instrument information, melody information, chord information, and beat information as described in FIG. 1.

The parameter setting unit 102 sets the designated tempo based on the information input by a user via the input unit 109, the information indicating the movement of the user detected by the acceleration sensor 110, or the time-series data described in the tempo sequence data D1. In addition, the parameter setting unit 102 sets the reproduction time length of the remixed musical composition based on the information input by the user via the input unit 109. The input unit 109 is for the user inputting information, such as a keyboard, a keypad, a mouse, a touch panel, a graphical user interface, or the like. In addition, the acceleration sensor 110 is a sensor which detects acceleration generated in accordance with the movement of the user.

The designated tempo and the reproduction time length set by the parameter setting unit 102 are input to the target musical composition section extracting unit 103. When the designated tempo and the reproduction time length are input, the target musical composition section extracting unit 103 extracts musical composition sections suitable for creating remixed musical composition with the input designated tempo (hereinafter, referred to as target musical composition sections). At this time, the target musical composition section extracting unit 103 reads the metadata D2 stored on the storage apparatus 101 and extracts the target musical composition sections based on the read metadata D2. For example, the target musical composition section extracting unit 103 refers to the beat information included in the metadata D2 and extracts the musical composition sections with tempos close to the designated tempo (in a rage of the designated tempo±10%, for example). The information of the target musical composition sections extracted by the target musical composition section extracting unit 103 is input to the harmonization section extracting unit 104.

When the information of the target musical composition sections is input, the harmonization section extracting unit 104 selects one target musical composition section from among the input target musical composition sections based on user's selection, random selection, or selection based on a predetermined algorithm. Then, the harmonization section extracting unit 104 extracts another target musical composition section that fits in with the chord progression of the selected target musical composition section (hereinafter, referred to as a targeted section). However, another target musical composition section extracted here may fit in with a section with a predetermined length at the top of the target musical composition section and with a section with a predetermined length at the end of the targeted section. The section with a predetermined length here is a section reproduced simultaneously during the reproduction of the remixed musical composition.

In addition, the harmonization section extracting unit 104 sets the extracted target musical composition section to a new targeted section and extracts another target musical composition section that fits in with the chord progression of the new targeted section. Furthermore, the harmonization section extracting unit 104 repeatedly performs setting of a targeted section and extraction of another target musical composition section. The pair of the target musical composition sections extracted by the harmonization section extracting unit 104 as described above is input to the mixing and reproducing unit 105. When the target musical composition sections are input, the mixing and reproducing unit 105 reads the musical composition data D3 stored on the storage apparatus 101 and reproduces the music data D3 corresponding to the input pair of the target musical composition sections. For example, the mixing and reproducing unit 105 inputs a sound signal corresponding to the musical composition data D3 to the speaker 106 and outputs the sound via the speaker 106, for example.

In addition, the mixing and reproducing unit 105 may output a movie signal for displaying a movie, which changes in accordance with the sound output through the speaker 106, via the output unit 107. Moreover, the mixing and reproducing unit 105 may output a sound signal corresponding to the musical composition data D3 via the output unit 107. The output unit 107 is an input and output terminal to which a display apparatus or external devices (such as earphones, a headset, a music player, an acoustic equipment, and the like)

are connected. In addition, the sequence control unit 108 is for controlling the operations of the parameter setting unit 102, the target musical composition section extracting unit 103, the harmonization section extracting unit 104, and the mixing and reproducing unit 105.

The brief description has been given above of the overall configuration of the musical composition reproducing apparatus 100 according to this embodiment. Hereinafter, more detailed description will be given of the functions and the operations of the parameter setting unit 102, the target musical composition section extracting unit 103, the harmonization section extracting unit 104, the mixing and reproducing unit 105, and the sequence control unit 108 as main components of the musical composition reproducing apparatus 100 according to this embodiment.

(1-2-2: Functions of Parameter Setting Unit 102)

First, detailed description will be given of functions of the parameter setting unit 102. As described above, the parameter setting unit 102 is for setting the designated tempo and the reproduction time length. The designated tempo set by the parameter setting unit 102 corresponds to the tempo of the remixed musical composition. In addition, the designated tempo set by the parameter setting unit 102 is used when musical composition sections to be included in the remixed musical composition are extracted. Moreover, the reproduction time length set by the parameter setting unit 102 corresponds to the reproduction time length of the remixed musical composition constituted by joining the musical composition sections.

The above designated tempo is determined by a method of using tempo information input via the input unit 109, a method of using acceleration information detected by the acceleration sensor 110, a method of using the tempo sequence data D1 stored on the storage apparatus 101, or the like. For example, when tempo information (a value or a range of tempo) is input via the input unit 109, the parameter setting unit 102 sets the designated tempo based on the input tempo information.

In addition, when the acceleration information detected by the acceleration sensor 110 is used, the parameter setting unit 102 converts the acceleration information input from the acceleration sensor 110 into tempo information (a value or a range of tempo) and sets the designated tempo based on the tempo information. The acceleration sensor 110 can output the time-series data of the acceleration reflecting the tempo of jogging or walking of the user. Therefore, it is possible to detect the tempo of the movement of the user by analyzing the time-series data and extracting cycles and the like of the change in the acceleration.

In addition, when the tempo sequence data D1 is used, the parameter setting unit 102 reads the tempo sequence data D1 stored on the storage apparatus 11 and sets the tempo in accordance with the reproduction time indicated by the tempo sequence data D1 to the designated tempo. The tempo sequence data D1 is time-series data, which changes in accordance with the reproduction time, as the curve shown by a broken line in FIG. 4 (where the horizontal axis represents the reproduction time). In such a case, the designated tempo set by the parameter setting unit 102 is time-series data which changes over the passage of the reproduction time.

Figure 3:
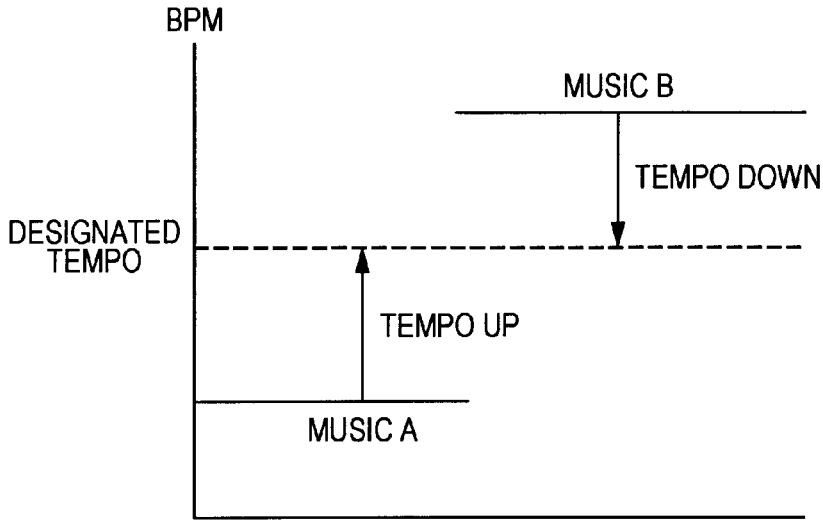
FIG. 3 is an explanatory diagram for illustrating a tempo adjustment method according to the embodiment.

The designated tempo set by the parameter setting unit 102 as described above is used as the tempo of the remixed musical composition. Specifically, the designated tempo is used for tempo adjustment in the musical composition sections (music A and music B in the example of FIG. 3) constituting the remixed musical composition as shown in FIG. 3 (where the horizontal axis represents the reproduction time). Since the tempo of the music A is smaller than the designated tempo in the case of FIG. 3, the tempo of the music A is raised up to the designated tempo. On the other hand, since the tempo of the music B is greater than the designated tempo, the tempo of the music B is lowered to the designated tempo. When the designated tempo does not change in accordance with the reproduction time, the tempo of each musical composition section constituting the remixed musical composition is adjusted as in FIG. 3.

Figure 4:
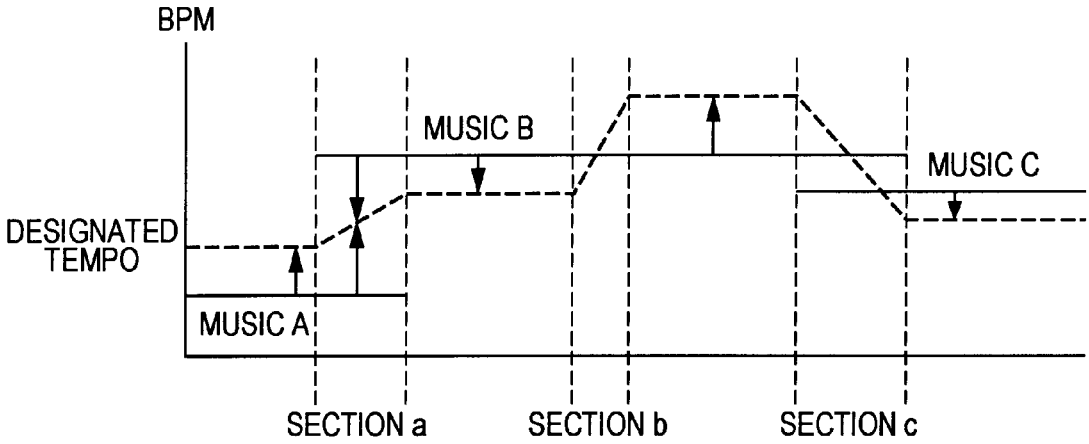
FIG. 4 is an explanatory diagram for illustrating a tempo adjustment method according to the embodiment.

On the other hand, when the designated tempo changes in accordance with the reproduction time (the example in FIG. 4 is a case of using the tempo sequence data D1), the tempo of each musical composition section constituting the remixed musical composition is adjusted as in FIG. 4. In the example of FIG. 4, the designated tempo is set in a slope manner in section a, section b, and section c in order to smoothly connect the different tempo in each musical composition section (music A, music B, and music C in the example of FIG. 4) constituting the remixed musical composition. That is, section a, section b, and section c are sections in which the tempo is gradually raised or lowered over the passage of the reproduction time. In addition, since the user has a sense of discomfort during the reproduction of the remixed musical composition when the tempo is suddenly changed, it is preferable that section a, section b, and section c are made to have sufficient length and the inclination of the slope is limited.

In the same manner as in the example of FIG. 3, the tempos of music A, music B, and music C are raised or lowered so as to match the designated tempo in accordance with the reproduction time. The same is true in section a, section b, and section c. For example, the tempo of music A is raised up to the designated tempo while the tempo of music B is lowered to the designated tempo at each reproduction time point in section a such that the tempo of music A and the tempo of music B are adjusted to the same designated tempo. Similarly, the tempos of music B and music C are raised or lowered in the section c so as to be adjusted to the same designated tempo. As a result of such tempo adjustment, music A and music B are reproduced at the same tempo in section a while music B and music C are reproduced at the same tempo in section c, for example.

The tempo adjustment is realized by changing the reproduction speed of each musical composition section. In addition, the beat positions and the bar tops are made to synchronize with each other between the musical composition sections reproduced simultaneously in the section in which a plurality of musical composition sections is reproduced simultaneously (section a and section c in the example of FIG. 4). Therefore, reproduction is performed while the tempos (speeds) and the beats (phases) are synchronized between a plurality of musical composition sections in section a and section c in which a plurality of musical composition sections are reproduced simultaneously. In addition, tempo adjustment is performed in section b in the example of FIG. 4 such that the tempo of music B is gradually raised in accordance with the designated tempo.

It is possible to create a remixed musical composition suitable for an exercise program if the tempo of the remixed musical composition can be changed over the passage of time as described above. For example, it is possible to create a remixed musical composition suitable for an exercise program, in which the tempo is set to be slow for the first state, gradually raised, made to reach the tempo at the maximum speed in the later stage, and then gradually lowered for cooling down. In other words, it is possible to work through an effective exercise program by preparing the tempo sequence data D1 corresponding to the exercise program created in advance and doing exercises while listening to the remixed musical composition reproduced based on the tempo sequence data D1.

The above description has been given of the functions and the operations of the parameter setting unit 102. In addition, the tempo adjustment method based on the designated tempo was also introduced herein. The designated data is used not only as the tempo of the remixed musical composition but for extraction of the musical composition sections constituting the remixed musical composition, as will be described later.

(1-2-3: Functions of Target Musical Composition Section Extracting Unit 103)

Figure 6:
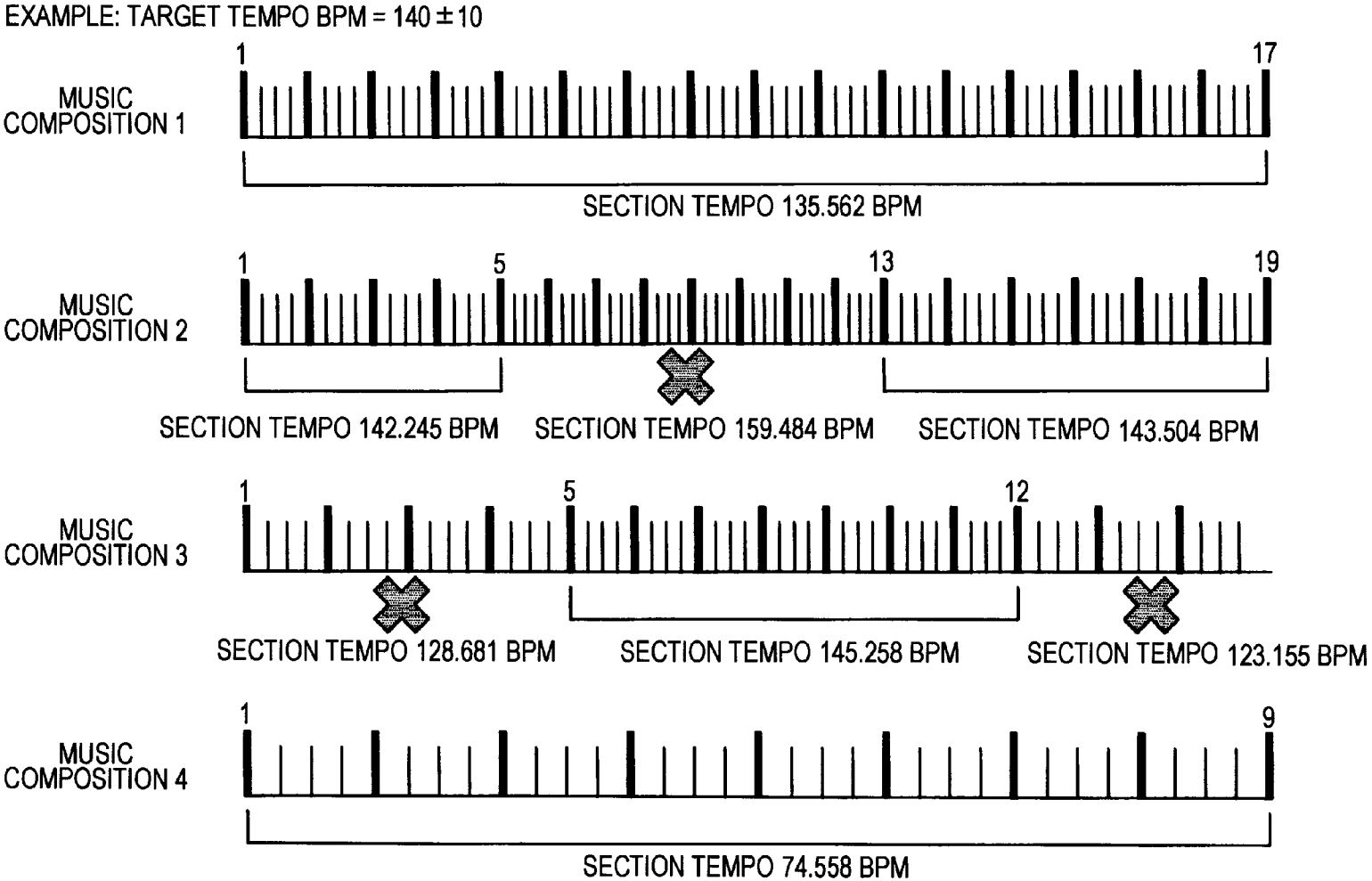
FIG. 6 is an explanatory diagram for illustrating a musical composition section extracting method according to the embodiment.

Next, description will be given of functions and operations of the target musical composition section extracting unit 103. As described above, the target musical composition section extracting unit 103 is for extracting the musical composition sections (target musical composition sections) which adapt to the designated tempo with the use of the metadata D2 stored on the storage apparatus 101 based on the designated tempo set by the parameter setting unit 102. For example, the target musical composition section extracting unit 103 extracts musical composition sections with tempos included in a range of about several % on the basis of the designated tempo (hereinafter, referred to as a designated tempo range) as shown in FIG. 6 based on the beat information included in the metadata D2. FIG. 6 shows a method of extracting musical composition sections in the designated tempo range of 140±10 BPM (Beat Per Minute) from among the music 1 to the music 4.

Figure 5:
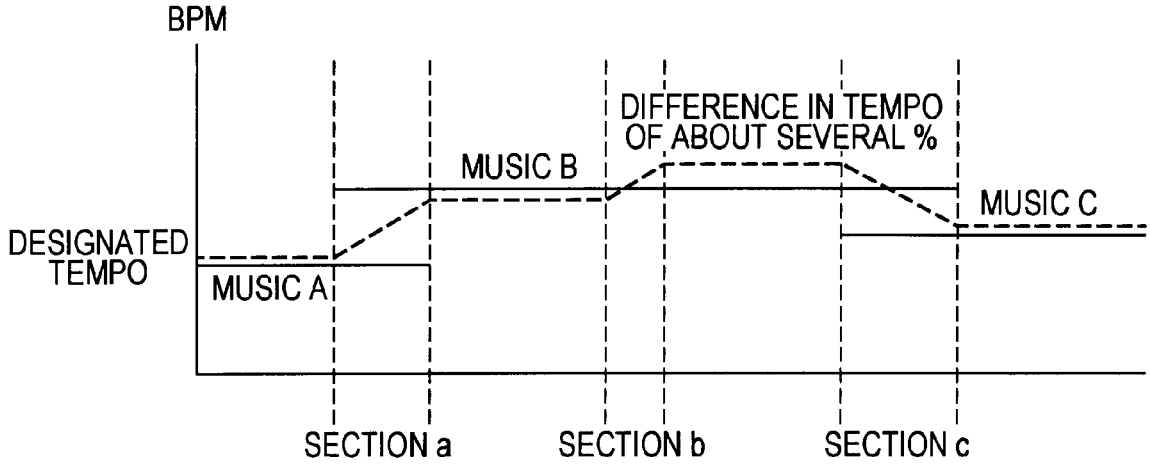
FIG. 5 is an explanatory diagram for illustrating a musical composition section extracting method according to the embodiment.

As described above, the tempo of each musical composition section constituting the remixed musical composition is adjusted to the designated tempo. Therefore, if the tempo of the musical composition section to be included in the remixed musical composition is totally different from the designated tempo, the musical composition section is reproduced at a tempo which is greatly different from that of the original music. As a result, the user has a strong sense of discomfort with respect to the remixed musical composition. Therefore, the target musical composition section extracting unit 103 extracts the musical composition section with the tempos included in the range of several % on the basis of the designated tempo as shown in FIG. 5. However, if the designated tempo range is excessively narrow, there is a possibility that musical composition section with the tempo within the designated tempo range is not extracted. Accordingly, it is preferable that the designated tempo range is set to the designated tempo±about 10%.

In addition, the tempo may be changed in one musical composition in some cases (see music 2 and music 3 in FIG. 6, for example). Therefore, the target musical composition section extracting unit 103 scans the musical composition sections that adapt to the designated tempo range while the musical composition sections are changed in units of beats in the individual musical compositions. In addition, the top and the end of the musical composition sections are made to synchronize with the beat positions. When the metadata D2 includes information indicating the bar top position, however, it is preferable that the positions of the top and the end of the musical composition section are made to synchronize with the bar top. In so doing, the melody of the remixed musical composition which is finally obtained becomes more natural.

When the target musical composition sections are extracted, the target musical composition section extracting unit 103 maintains information such as extracted target musical composition sections, IDs of the musical compositions including the target musical composition sections (hereinafter, referred to as musical composition IDs), the tempos of the original music of the target musical composition sections (hereinafter, referred to as original tempos), and the like in the form of a list. For example, the information such as the target musical composition sections, the musical composition IDs, the original tempos, and the like is maintained as a target musical composition section list as shown in FIG. 7. As shown in FIG. 7, indexes, musical composition IDs (music IDs), the target musical composition sections (start positions and the end positions), the original tempos (section tempos), sense of beat, and the like are stored in the target musical composition section list as shown in FIG. 7, for example. In addition, the sense of beat is information indicating the number of beats (four beats, eight beats, sixteen beats, or the like) of the musical composition including the target musical composition section.

An eight-beat musical composition acoustically makes a listener sense not only the actual tempo but also a tempo which is twice as fast as the actual tempo. Similarly, a sixteen-beat musical composition acoustically makes a listener sense a tempo which is twice or four times as fast as the actual tempo. Therefore, the target musical composition section extracting unit 103 extracts the target musical composition sections in consideration of the sense of beat of the musical compositions. For example, the target musical composition section extracting unit 103 extracts a musical composition section (the music 4 in FIG. 6) with a tempo, which is within the designated tempo range when it is twice as fast as the actual tempo, for an eight-beat musical composition, for example. Similarly, the target musical composition section extracting unit 103 extracts a musical composition section with a tempo, which is within the designated tempo range when it is twice or four times as fast as the actual tempo. When the sense of beat of the musical composition is eight beats, sixteen beats, or the like, the tempo which is twice or four times as fast as the original tempo may be recorded in the target musical composition section list as shown in FIG. 7.

Generally, the tempo is expressed with a unit of BPM indicating how many beats there are to the minute. However, the tempo which is acoustically sensed is considered herein, and the tempo expressed by the following equation (2) (hereinafter, referred to as an interbeat BPM) is used as a unit. An eight-beat musical composition with an original tempo of 80 BPM is expressed as a musical composition with the interbeat BPM of 160 BPM with the use of this expression. The target musical composition section extracting unit 103 compares the designated tempo range with the original tempo and the interbeat BPM and extracts the musical composition sections with the original tempo or the interbeat BPM within the designated tempo range. In addition, it is assumed that the sense of beat is added in advance to each musical composition. For example, information indicating the sense of beat may be included in the beat information included in the metadata D2.

$$\text{Interbeat } BPM = \frac{\text{Sampling Frequency}}{\text{Number of Interbeat samples}} \times 60 \times \frac{\text{Sense of Beat}(=4, 8, 16)}{4} = \text{Original Tempo(Average } BPM) \times \frac{\text{Sense of Beat}}{4} \quad (2)$$

As described above, the target musical composition section extracting unit 103 reads the metadata D2 stored on the storage apparatus 101 and calculates the original tempo and the interbeat BPM of each musical composition section based on the beat information included in the metadata D2. Then, the target musical composition section extracting unit 103 extracts as the target musical composition sections the musical composition sections with the original tempos or the inter-beat BPM within the designated tempo range. Then, the target musical composition section extracting unit 103 creates the target musical composition section list as shown in FIG. 7 from the extracted target musical composition sections. The information of the target musical composition section list created by the target musical composition section extracting unit 103 as described above is input to the harmonization section extracting unit 104.

The above description has been given of the functions and the operations of the target musical composition section extracting unit 103. As described above, the target musical composition section extracting unit 103 extracts musical composition sections, which adapt to the designated tempo set by the parameter setting unit 102, as the target musical composition sections.

(1-2-4: Functions of Harmonization Section Extracting Unit 104)

Next, description will be given of the functions and the operations of the harmonization section extracting unit 104. As described above, the harmonization section extracting unit 104 is for extracting musical composition sections suitable for constituting the remixed musical composition from among the target musical composition sections extracted by the target musical composition section extracting unit 103. Particularly, the harmonization section extracting unit 104 extracts a combination of target musical composition sections whose chord progress fits in with each other based on the chord information included in the metadata D2 stored on the storage apparatus 101.

First, the harmonization section extracting unit 104 selects a target musical composition section (targeted section) to be reproduced first as the remixed musical composition from the target musical composition section list. At this time, harmonization section extracting unit 104 may provide the contents of the target musical composition section list to the user and select the target musical composition section designated by the user via the input unit 109 as the targeted section. In addition, the harmonization section extracting unit 104 may select the target musical composition section extracted based on a predetermined algorithm as the targeted section. Furthermore, the harmonization section extracting unit 104 may randomly extract the target musical composition section and select the extracted target musical composition section as the targeted section.

Figure 8:
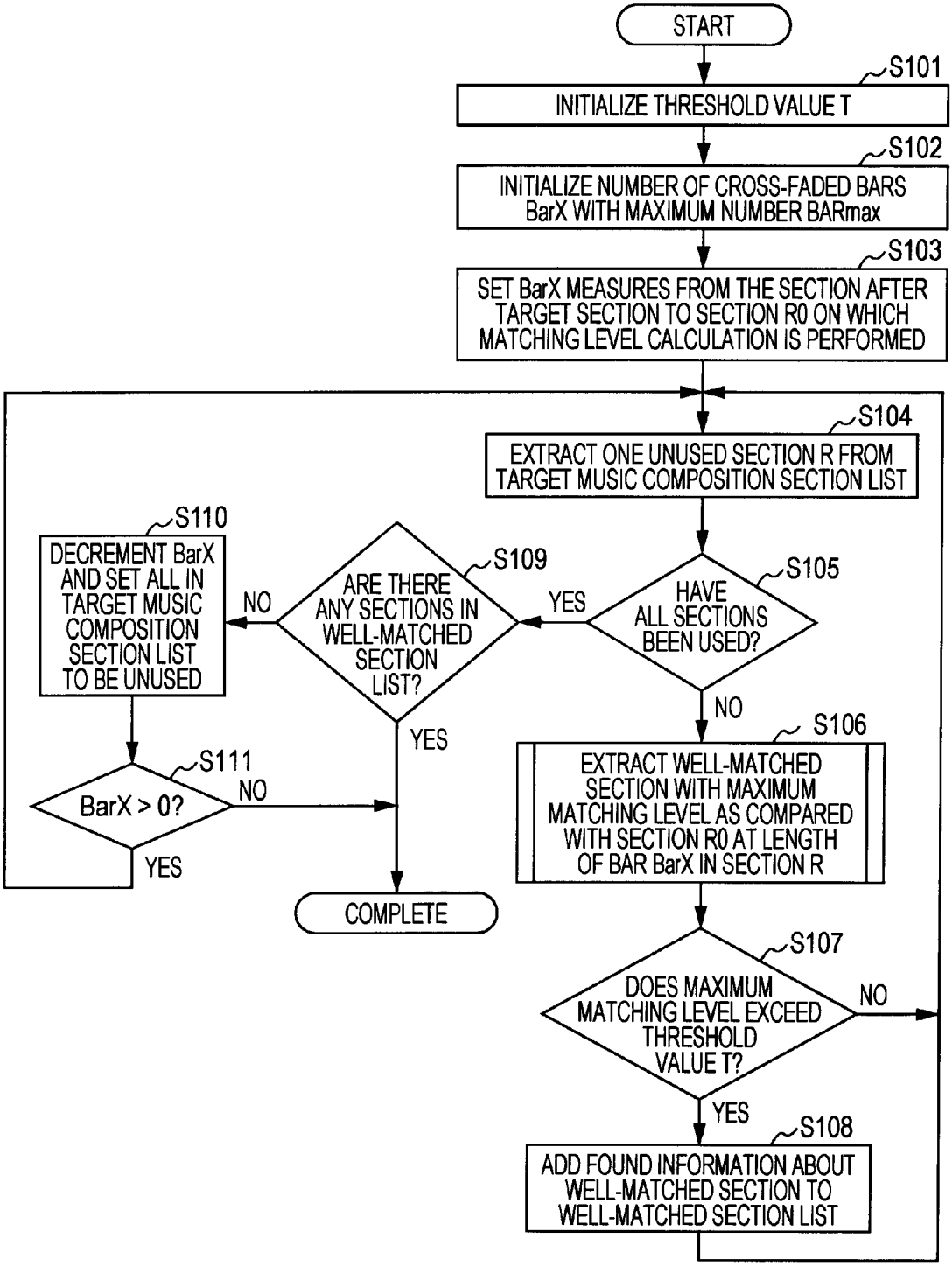
FIG. 8 is an explanatory diagram for illustrating a harmonization section extracting method according to the embodiment.

The harmonization section extracting unit 104 which has selected the targeted section executes the processing flow shown in FIG. 8 and extracts a target musical composition section suitable for constituting a remixed musical composition by being joined to the targeted section. At this time, the harmonization section extracting unit 104 extracts a partial section of the target musical composition section, in which the chord progression fits in with that of a partial section positioned near the end of the targeted section, (hereinafter, referred to as a harmonization section). Here, specific description will be given of the processing of extracting the harmonization section by the harmonization section extracting unit 104 with reference to FIG. 8.

In addition, the harmonization section is a part which is reproduced simultaneously as a partial section positioned near the end of the targeted section. In the example of FIG. 8, it is assumed that the both sections are reproduced simultaneously so as to be cross-faded. Moreover, it is assumed that the harmonization section is selected in units of bars in the example of FIG. 8. It is a matter of course that the processing flow of the harmonization section extracting unit 104 according to this embodiment is not limited thereto. For example, it is possible to extract the harmonization section by the same processing flow even when the above both sections are reproduced simultaneously in a non-cross-faded manner. In addition, it is possible to extract the harmonization section by the same processing flow even when the harmonization section is selected in units of beats.

As shown in FIG. 8, the harmonization section extracting unit 104 firstly initializes a threshold value T to an appropriate value (S101). This threshold value T is a parameter for evaluating the harmonization level between the targeted section and the extracted harmonization section. Particularly, this threshold value T shows the minimum value of the harmonization level between the harmonization section which is finally extracted and the targeted section. When the threshold value T is initialized, the harmonization section extracting unit 104 initializes the number of bars BarX to be cross-faded with a predetermined maximum number BARmax (S102). Then, the harmonization section extracting unit 104 sets the BarX bars from the end of the targeted section to the target section R0 of the harmonization level calculation which will be described later (S103). In addition, the harmonization level is a parameter representing a degree of harmonization (similarity) between chord progression of a certain musical composition section and chord progression of another musical composition section.

When the target section R0 of the harmonization level calculation is set, the harmonization section extracting unit 104 extracts one unused section R from the target musical composition section list (S104). In addition, the unused section information R means target musical composition section for which evaluation regarding whether or not musical composition section available as a harmonization section is included has not been performed from among the target musical composition sections included in the target musical composition section list. In addition, a use flag indicating used/unused states may be described in the target musical composition section list. The harmonization section extracting unit 104 which has extracted the unused section R in Step 104 determines whether or not all target musical composition sections have been used (S105). When all target musical composition sections have been used, the harmonization section extracting unit 104 moves on to the processing in Step S109. On the other hand, when not all target musical composition sections have been used, the harmonization section extracting unit 104 moves on to the processing in Step S106.

When the processing proceeds to Step S106, the harmonization section extracting unit 104 calculates the harmonization level between a partial section with BarX-bar length in the unused section R and the target section R0 of the harmonization level calculation. At this time, the harmonization section extracting unit 104 calculates the harmonization level with the target section R0 while moving the partial section with BarX-bar length within the unused section R. Then, the harmonization section extracting unit 104 extracts the partial section with the barX-bar length corresponding to the maximum harmonization level from among the calculated harmonization levels as the harmonization section (S106). The harmonization section extracting unit 104 which has extracted the harmonization section moves on to the processing in Step S107 and determines whether or not the harmonization level corresponding to the extracted harmonization section (hereinafter, referred to as a maximum harmonization level) exceeds the threshold value T (S107).

When the maximum harmonization level exceeds the threshold value T, the harmonization section extracting unit 104 moves on to the processing in Step S108. On the other hand, when the maximum harmonization level does not exceed the threshold value T, the harmonization section extracting unit 104 moves on to the processing in Step S104. After the determination processing in Step S107, the harmonization section extracting unit 104 describes use flag indicating the use of the section R in the targeted musical composition section list. When the processing proceeds to Step S108, the harmonization section extracting unit 104 maintains the information regarding the extracted harmonization section in the form of a list (S106). For example, the harmonization section extracting unit 104 adds the information regarding the harmonization section to the harmonization section list as shown in FIG. 9. Then, the harmonization section extracting unit 104 moves on to the processing in Step S104.

As described above, the harmonization section extracting unit 104 repeatedly executes the processing of Steps S104 to S108 until all target musical composition sections are used. Then, when all target musical composition sections have been used in Step S105, the harmonization section extracting unit 104 moves on to the processing in Step S109. The harmonization section extracting unit 104 which has moved on to the processing in Step S109 determines whether or not the information regarding the harmonization section is present in the harmonization section list (S109). When the information regarding the harmonization section is present in the harmonization section list, harmonization section extracting unit 104 completes a series of processing. On the other hand, when the information regarding the harmonization section is not present in the harmonization section list, harmonization section extracting unit 104 moves on to the processing in Step S110.

When the processing proceeds to Step S110, the harmonization section extracting unit 104 decrements BarX and sets the use flag described in the target musical composition list to be unused (S110). Then, the harmonization section extracting unit 104 determines whether BarX>0 is satisfied (S111). When BarX>0 is satisfied, the harmonization section extracting unit 104 moves on the processing in Step S104. On the other hand, when BarX>0 is not satisfied, the harmonization section extracting unit 104 completes a series of processing. In such a case, no information regarding the harmonization section has been added to the harmonization section list. That is, no appropriate harmonization section for cross-fade reproduction has been found with respect to the targeted section.

The processing flow may be configured such that the threshold value T is decreased and the processing from Step S102 is executed again when no harmonization section has been added to the harmonization section list. In addition, the processing flow may be configured such that the targeted section is selected again and the processing from Step S101 is executed again when no harmonization section has been added to the harmonization section list.

Here, supplemental description will be given of a calculation method of the harmonization level. The calculation of the harmonization level (similarity in the chord progression) can be realized by applying a method disclosed in Japanese Unexamined Patent Application Publication No. 2008-164932. According to this method, the chord progressions of two musical composition sections are compared with each other, and a high similarity (corresponding to the harmonization level in this embodiment) is associated with the combination between musical composition sections with similar chord progressions. In this method, the possibility in that the chord progressions are matched after modulation is also taken into consideration when the musical composition sections with different keys are compared with each other. For example, the relative chord steps of the chord progression C, F, G, Em in a musical composition with a key of C (G major) synchronize with those of the chord progression E, G♯, B, G♯m in a musical composition with a key of E (E major).

That is, if the key of the musical composition with a key of C is modulated by raising four half steps, chord progression constituted by the same absolute pitch as those in the musical composition with a key of E is obtained. In such a case, discordance is not generated when both musical compositions are reproduced simultaneously while the beats thereof are made to synchronize with each other. As described above, the harmonization degree may be increased due to the modulation in some cases. Accordingly, the harmonization section extracting unit 104 adds the modulation steps to the harmonization section extraction list when the modulation is performed to enhance the level of harmonization. As shown in FIG. 9, information such as indexes, indexes of the corresponding target musical composition section list, the ranges of the harmonization sections (start positions and the end positions), the harmonization levels, the modulation steps, the weighting coefficient, and the like are recorded in the harmonization section list.

In FIG. 9, information of the harmonization section extracted in the case of BarX=4 is described. In this example, the maximum value of the harmonization level is 1.0. In addition, the weighting coefficient included in the harmonization section extraction list is a coefficient for reflecting the element other than the harmonization level into the selection of the harmonization section. For example, the weighting coefficient is used to extract musical compositions in a specific category or by a specific instrument with a priority, or to extract a part such that the break of the musical composition section does not correspond to the half way through the lyrics, with a priority. For example, a greater weighting coefficient is set to a harmonization section in the same category as that of the targeted section. Similarly, a greater weighting coefficient is set to a harmonization section with the same mood as that in the targeted section.

The above description has been given of the functions and the operations of the harmonization section extracting unit 104. As described above, the harmonization section extracting unit 104 extracts a partial section of a target musical composition section which adapts to the partial section of the targeted section as a harmonization section from among the target musical composition sections. At this time, the harmonization section extracting unit 104 extracts the harmonization sections with the chord progression which is similar to that of the partial section of the targeted section and creates the harmonization section list with the information of the extracted harmonization sections. Then, the thus create harmonization section list is input to the mixing and reproducing unit 105.

(1-2-5: Functions of Mixing and Reproducing Unit 105)

Next, description will be given of the functions and the operations of the mixing and reproducing unit 105. The mixing and reproducing unit 105 is for mixing and reproducing two musical composition sections. First, the mixing and reproducing unit 105 refers to the harmonization section list created by the harmonization section extracting unit 104 and calculates the product between the harmonization level of each harmonization section and the weighting coefficient. Then, the mixing and reproducing unit 105 selects the harmonization section with the greatest product from among the calculated products. Subsequently, the mixing and reproducing unit 105 mixes and reproduces the section corresponding to BarX bars from the end of the targeted section and the selected harmonization section.

Figure 11:
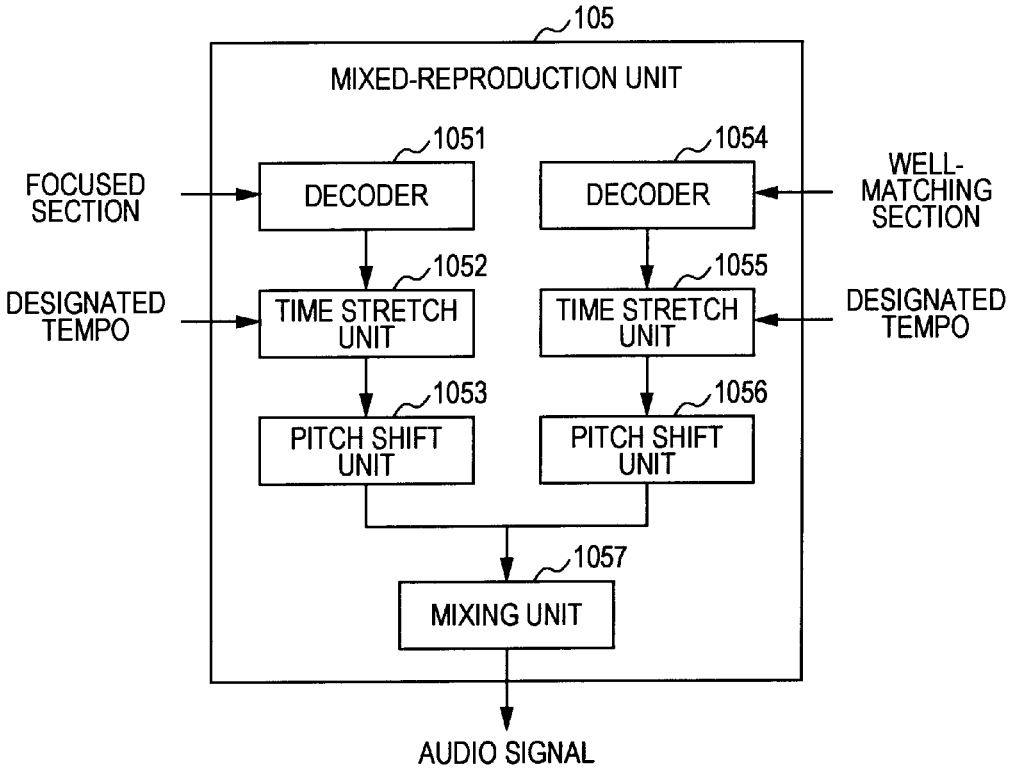
FIG. 11 is an explanatory diagram for illustrating a detailed functional configuration of a mixing and reproducing unit included in a musical composition reproducing apparatus according to the embodiment.
Figure 12:
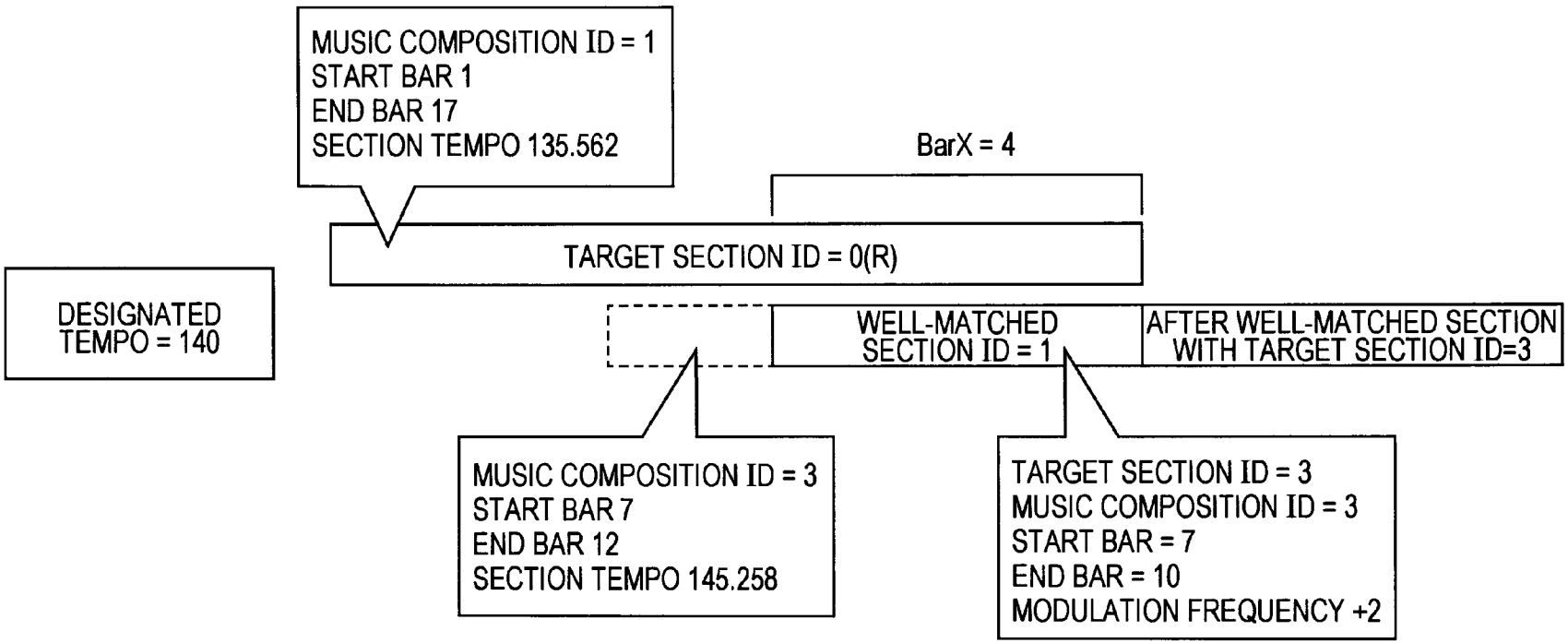
FIG. 12 is an explanatory diagram for illustrating a mixing and reproducing method according to the embodiment.

In order to mix and reproduce two musical composition sections (targeted section and the harmonization section), the mixing and reproducing unit 105 has a functional configuration as shown in FIG. 11. As shown in FIG. 11, the mixing and reproducing unit 105 includes two decoders 1051 and 1054, two time stretch units 1052 and 1055, two pitch shift units 1053 and 1056, and a mixing unit 1057. In addition, it is possible to omit the decoders 1051 and 1054 when the musical composition data D3 is uncompressed sound.

The decoder 1051 is for decoding the musical composition data D3 corresponding to the targeted section. In addition, the time stretch unit 1052 is for making the tempo of the musical composition data D3 corresponding to the targeted section to synchronize with the designated tempo. Then, the pitch shift unit 1053 is for changing the key of the musical composition data D3 corresponding to the targeted section.

First, the musical composition data D3 corresponding to the targeted section is read from the musical composition data D3 stored on the storage apparatus 101 by the decoder 1051. Then, the decoder 1051 decodes the read musical composition data D3. The musical composition data D3 decoded by the decoder 1051 is input to the time stretch unit 1052. When the decoded musical composition data D3 is input, the time stretch unit 1052 makes the tempo of the input musical composition data D3 synchronize with the designated tempo. The musical composition data D3 with a tempo adjusted to the designated tempo is input to the pitch shift unit 1053. When the musical composition data D3 with the designated tempo is input, the pitch shift unit 1053 changes the key of the input musical composition data D3, if necessary. The musical composition data D3 with the key changed by the pitch shift unit 1053, if necessary, is input to the mixing unit 1057.

The decoder 1054 is for decoding the musical composition data D3 corresponding to the harmonization section. In addition, the time stretch unit 1055 is for making the tempo of the musical composition data D3 corresponding to the harmonization section to synchronize with the designated tempo. Moreover, the pitch shift unit 1056 is for changing the key of the musical composition data D3 corresponding to the harmonization section.

First, the musical composition data D3 corresponding to the harmonization section is read from the musical composition data D3 stored on the storage apparatus 101 by the decoder 1054. Then, the decoder 1054 decodes the read musical composition data D3. The musical composition data D3 decoded by the decoder 1054 is input to the time stretch unit 1055. When the decoded musical composition data D3 is input, the time stretch unit 1055 makes the tempo of the input musical composition data D3 synchronize with the designated tempo.

The musical composition data D3 with a tempo adjusted to the designated tempo is input to the pitch shift unit 1056. When the musical composition data D3 with the designated tempo is input, the pitch shift unit 1056 changes the key of the input musical composition data D3, if necessary. At this time, the pitch shift unit 1056 changes the key of the musical composition data D3 based on the modulation steps described in the harmonization section list. The musical composition data D3 with a key changed by the pitch shift unit 1056, if necessary, is input to the mixing unit 1057.

When the musical composition data D3 corresponding to the targeted section and the musical composition data D3 corresponding to the harmonization section are input, the mixing unit 1057 mixes the two musical composition data items D3 while synchronizing the beats thereof and creates a sound signal to be input to the speaker 106 (or the output unit 107). Since the two musical composition data items D3 have the same tempos as described above, the user does not have a sense of discomfort in relation to the tempo even when the two musical composition data items D3 are reproduced simultaneously.

Here, a method will be more specifically examined in which the target musical composition section corresponding to the index 0 in the target musical composition section list is set to the targeted section R0 and the harmonization section corresponding to the index 1 in the harmonization section list is mixed with the targeted section R0. In the example of FIG. 9, the index (the target section ID) in the targeted musical composition section list corresponding to the index 1 in the harmonization section list (harmonization section ID=1) is 3. It can be understood from this that the musical composition ID corresponding to the harmonization section with the harmonization section ID=1 is 3, with reference to FIG. 7. In addition, it can be understood that the harmonization section with the harmonization section ID=1 is a section from the seventh bar to the tenth bar with reference to the harmonization section list shown in FIG. 9.

That is, in this example, the section corresponding to BarX bars from the end of the targeted section R0 (BarX=4 in the example of FIG. 12) and the harmonization section with the harmonization section ID=1 are mixed. At this time, the time stretch units 1052 and 1055 perform speed adjustment such that the tempo of the musical composition data D3 corresponding to each section as the target of mixing synchronizes with the designated tempo. In addition, the reproduction speed intensification used in the speed adjustment is (designated tempo/original tempo). In addition, when the modulation steps of the harmonization section as the mixing target in the harmonization section list is set to the value other than 0, the music interval of the musical composition data D3 corresponding to the harmonization section is raised or lowered by the modulation steps for adjustment.

Figure 13:
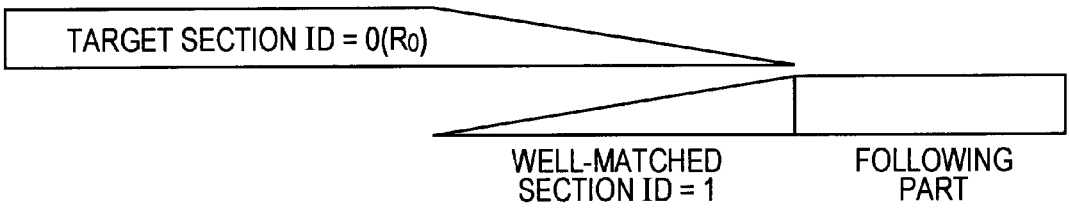
FIG. 13 is an explanatory diagram for illustrating a cross-fade method according to the embodiment.

In addition, the mixing unit 1057 may perform cross-fade as shown in FIG. 13 when mixing the musical composition data D3 corresponding to the targeted section with the musical composition data D3 corresponding to the harmonization section. That is, the volume of the musical composition data D3 corresponding to the targeted section is reduced over the passage of the reproduction time while the volume of the musical composition data D3 corresponding to the harmonization section is raised at an overlapping part between the targeted section and the harmonization section. Such cross-fade makes it possible to realize natural shift from the musical composition data D3 corresponding to the targeted section to the musical composition data D3 corresponding to the harmonization section.

Although a method in which cross-fade was performed on entire sections to be mixed was shown in the example of FIG. 13, the time for the cross-fade may be shortened in accordance with the harmonization level of the sections to be mixed. For example, there is a possibility in that discordance is generated in the section in which two musical composition data items D3 are mixed when the harmonization level is low. Accordingly, it is preferable not to perform such long cross-fade when the harmonization level is low. On the other hand, there is a low possibility in that discordance is generated even if the cross-fade is performed on the entire sections to be mixed when the harmonization level is high. Therefore, the mixing unit 1057 sets the section to be cross-faded to be longer when the harmonization level is high, and sets the period of cross-fade to be shorter when the harmonization level is low.

In addition, the mixing unit 1057 may use a phrase for joining sections to be mixed. The phrase for joining is sound data constituted only by a part of sound of instruments (drum sound, for example) included in the musical composition data D3, for example. If the phrase for joining is used, it is possible to reduce the sense of discomfort given to the user at the joining part even when the sections to be mixed is short or when the harmonization level is low.

The above description has been given of the functions and the operations of the mixing and reproducing unit 105. As described above, the mixing and reproducing unit 105 can mix and reproduce a part of the targeted section and the harmonization section. In addition, the mixing and reproducing unit 105 makes the tempo of the section to be mixed and reproduced synchronize with the designated tempo, synchronizes the beats of both sections, and performs modulation necessary for the harmonization section. By performing such processing, it is possible to remove the user's sense of discomfort during the reproduction of the mixed sections.

(1-2-6: Functions of Sequence Control Unit 108)

Next, description will be given of the functions and the operations of the sequence control unit 108. As described above, the sequence control unit 108 is for controlling the operations of the parameter setting unit 102, the target musical composition section extracting unit 103, the harmonization section extracting unit 104, and the mixing and reproducing unit 105. In the above description relating to the harmonization section extracting unit 104 and the mixing and reproducing unit 105, a method in which one targeted section is mixed with one harmonization section was described. However, a sound signal for a remixed musical composition in which a plurality of sections is joined with each other in a seamless manner is created by repeatedly using this method in practice. The sequence control unit 108 plays a role in controlling the operations of the musical composition reproducing apparatus 100 such as controlling the above repetition.

Figure 14:
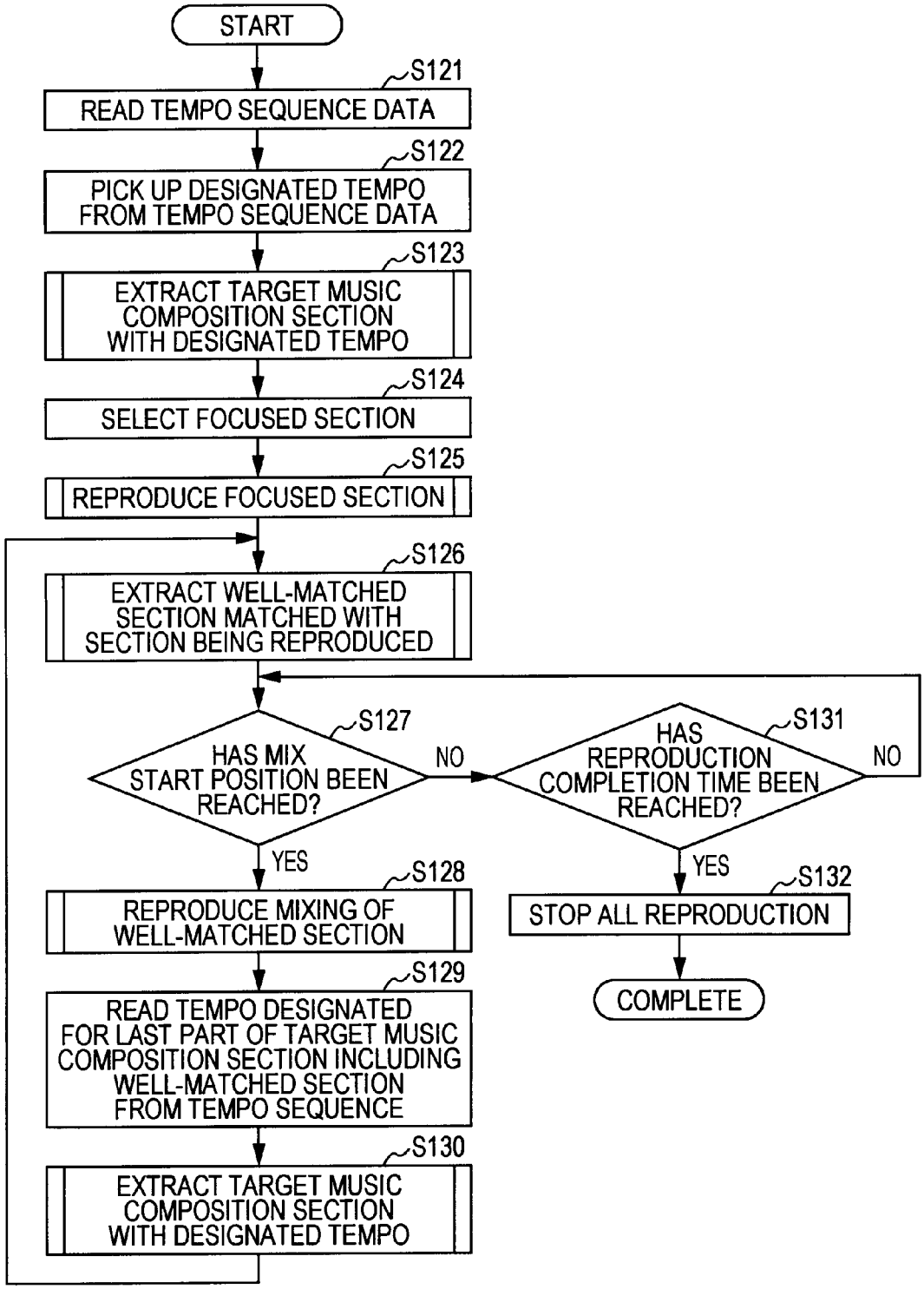
FIG. 14 is an explanatory diagram for illustrating a flow of sequence control according to the embodiment.

Here, description will be given of a control flow by the sequence control unit 108 with reference to FIG. 14. FIG. 14 is an explanatory diagram for illustrating the control flow by the sequence control unit 108. In addition, the example of FIG. 14 relates to a method in which the tempo sequence data D1 is stored on the storage apparatus 101 and the remixed musical composition is reproduced with the use of this tempo sequence data D1.

As shown in FIG. 14, the sequence control unit 108 firstly controls the parameter setting unit 102 to read the tempo sequence data D1 from the storage apparatus 101 (S121). Then, the sequence control unit 108 controls the parameter setting unit 102 to extract the designated tempo from the tempo sequence data D1 (S122). Then, the sequence control unit 108 controls the target musical composition section extracting unit 103 to extracts target musical composition sections which adapt to the designated tempo (S123). Then, the sequence control unit 108 controls the harmonization section extracting unit 104 to select the targeted section from among the target musical composition sections (S124).

Then, the sequence control unit 108 controls the mixing and reproducing unit 105 to reproduce the targeted section (S125). Then, the sequence control unit 108 controls the harmonization section extracting unit 104 to extract the harmonization section which is harmonized with the targeted section being reproduced (S126). Then, the sequence control unit 108 determines whether or not the reproduction position in the targeted section has reached the start point of the section to be mixed (hereinafter, referred to as a mixing start position) with the harmonization section (S127). When the reproduction position has reached the mixing start position, the sequence control unit 108 moves on to the processing in Step S128. On the other hand, when the reproduction position has not reached the mixing start position, the sequence control unit 108 moves on to the processing in Step S131.

When the processing proceeds to Step S128, the sequence control unit 108 controls the mixing and reproducing unit 105 to mix and reproduce the targeted section and the harmonization section (S128). Then, the sequence control unit 108 controls the parameter setting unit 102 to reads the designated tempo corresponding to the reproduction time at the end of the target musical composition section including the harmonization section from the tempo sequence data D1 (S129). Then, the sequence control unit 108 controls the target musical composition section extracting unit 103 to extract the target musical composition section which adapts to the designated tempo read in Step S129 (S130). When the extraction of the target musical composition section has been completed, the sequence control unit 108 moves on to the processing in Step S126.

When the processing proceeds to S131 in Step S127, the sequence control unit 108 determines whether or not the reproduction completion time has been reached (S131). When the reproduction completion time has been reached, the sequence control unit 108 moves on to the processing in Step S132. On the other hand, when the reproduction completion time has not been reached, the sequence control unit 108 moves on to the processing in Step S127. When the processing proceeds to Step S132, the sequence control unit 108 controls the mixing and reproducing unit 105 to stop the reproduction processing (S132) and completes a series of processing.

The above description has been given of the functions and the operations of the sequence control unit 108. As described above, the sequence control unit 108 controls the parameter setting unit 102, the target musical composition section extracting unit 103, the harmonization section extracting unit 104, and the mixing and reproducing unit 105 to execute processing such as extraction of the target musical composition section, extraction of the harmonization section that fits in with the targeted section, and mixing and reproducing of the targeted section and the harmonization section.

(Supplementary Explanation Regarding Designated Tempo which Changes in Time-Series Manner)

As described above, the musical composition reproducing apparatus 100 according to this embodiment can changes the tempo of the remixed musical composition in accordance with the reproduction time. For example, the parameter setting unit 102 sets a designated tempo in accordance with the reproduction time based on the tempo sequence data D1, and the mixing and reproducing unit 105 reproduces the musical composition section at the set designated tempo. Even when the parameter setting unit 102 sets the designated tempo which temporally changes in accordance with the detection result of the acceleration sensor 110, the mixing and reproducing unit 105 reproduces the musical composition section at the designated tempo in the same manner. With such a configuration, it becomes possible to mix and reproduce musical compositions at the tempo matched with the exercise program or mix and reproduce musical compositions at the tempo matched with the user's movement in real time.

However, the temporal change in the designated tempo does not simply change the tempo of the musical compositions to be finally reproduced. As described above, the designated tempo is used for extracting the target musical composition sections in this embodiment. Therefore, if the designated tempo is changed, the target musical composition sections to be extracted are changed. That is, a musical composition section of a musical composition with a fast original tempo is extracted when the fast tempo is designated, and a musical composition section of a musical composition with a slow original tempo is extracted when the slow tempo is designated. For example, since an exciting musical composition with a fast original tempo is reproduced when the user does rhythmical exercises, it is possible to further enhance the user's mood. On the other hand, since a musical composition with a calm melody and a slow original tempo is reproduced when the user does slow exercises for cooling down, it is possible to allow the user to be further relaxed.

As described above, the musical composition reproducing apparatus 100 according to this embodiment has a system in which the change in the designated tempo affects the extraction tendency of the target musical composition sections. Therefore, a musical composition suitable for fast reproduction and a musical composition suitable for slow reproduction are appropriately reproduced in accordance with the user's situation in a different manner from simply reproducing musical compositions with similar melodies at a fast or slow tempo.

(Supplementary Explanation Regarding Weighting Coefficient: Outline)

As described above, the target musical composition section extracting unit 103 extracts the target musical composition sections based on the designated tempo. Therefore, a combination of target musical composition sections in different categories are extracted, or a combination of target musical composition sections with different moods is extracted, in some cases even if the target musical composition sections are extracted based on the same designated tempo. In the case of a musical composition including vocal, a phrase of lyrics is interrupted at the top of the target musical composition section. Therefore, the user has a sense of discomfort at the joining part if target musical composition sections in different categories or with different moods are joined with each other even when the designated tempos synchronize with each other. In addition, if target musical composition sections are joined with each other in a manner in which a phrase of lyrics is interrupted at the end of each section, a phrase with no meaning is created at the joining part, and the user may have a sense of discomfort.

Thus, the method of extracting the harmonization section has been contrived such that the sections to be mixed are in the same category or have the same mood in this embodiment. Specifically, the harmonization section extracting unit 104 is configured to extract musical composition section in a category or with a mood corresponding to the targeted section as a harmonization section with the use of information included in the metadata D2. For example, a weight coefficient of the harmonization section with a predetermined same kind of metadata D2 (a category, mood, a type of instruments, a type of melody, and the like) as that of the targeted section is set to a large value, and a weight coefficient of the harmonization section in which a phrase of lyrics is interrupted at the end of the section is set to a small value. The harmonization section extracting unit 104 extracts the harmonization section with the use of a product between the harmonization level indicating the degree of harmonization level (similarity) of the chord progression and the weighting coefficient. Therefore, the harmonization section with a large weighting coefficient is easily extracted.

As a result, it is possible to reduce joining between musical composition sections in completely different categories or with completely different mood or joining between musical composition sections in which a phrase of lyrics is interrupted, and therefore, it is possible to reduce the sense of discomfort to be given to the user at the joining part. For example, there become less cases in which a classic musical composition and a rock musical composition are joined with each other. In addition, there become less cases in which a musical composition starts from a voice with no meaning.

(Supplementary Explanation 1 Regarding Weighting Coefficient: Example of Weighting in Accordance with Type of Melody Structure)

Here, description will be given of a setting method of a weighting coefficient in accordance with the melody information included in the metadata D2 with reference to FIG. 15. FIG. 15 is an explanatory diagram for illustrating a setting method of a weighting coefficient in accordance with a type of a melody structure.

FIG. 15 shows types of melody and a weighting coefficient corresponding to each type of melody. As the types of melody, there are introduction, melody A, melody B, a hook line, a main hook line, solo, bridge, ending, and the like. In addition, the main hook line means a hook like which is the most exciting part in the hook line, and generally represents the hook line appearing at the last of a musical composition. The types of melody are included in the metadata D2 as melody information. Therefore, it is possible to easily set a weighting coefficient based on the metadata D2 if information associating a type of melody with a weighting coefficient as shown in FIG. 15 is prepared. Such information may be stored on the storage apparatus 101 in advance, for example.

When the harmonization section includes a plurality of types of melody, a type of temporally longest melody may be used as a representative, or a kind of melody with the largest weighting coefficient may be used as a representative. However, the method of setting the weighting coefficient described herein is one example, and setting of a weighting coefficient may be configured to be adjustable in accordance with the system conditions or user operation of the musical composition reproducing apparatus 100. In addition, the setting may be made such that the weighting coefficient is temporally changed by performing weighting such that not many hook lines are included in the first half of the remixed musical composition while many hook lines are included in the second half thereof, for example.

(Supplementary Explanation 2 Regarding Weighting Coefficient: Example of Weighting in Accordance with Type of Instruments)

Next, description will be given of a method of setting a weighting coefficient in accordance with the instrument information included in the metadata D2 with reference to FIG. 16. FIG. 16 is an explanatory diagram for illustrating a method of setting a weighting coefficient in accordance with the type of the instrument information.

FIG. 16 shows types of the instrument and a weighting coefficient of the type of each instrument. As the types of the instruments, male vocal, female vocal, the piano, the guitar, the drum, the base guitar, the strings, the winds, and the like are exemplified. In addition, the strings mean stringed instruments such as the violin, the cello, and the like. The types of instruments are included in the metadata D2 as the instrument information. Therefore, it is possible to easily set a weighting coefficient based on the metadata D2 if information associating the types of instruments with the weighting coefficients as shown in FIG. 16 is prepared. Such information may be stored in advance on the storage apparatus 101.

The instruments are not exclusive unlike the types of melody. That is, a plurality of instruments is played simultaneously in many cases. Therefore, the harmonization section extracting unit 104 calculates the weighting coefficient to be used for the extraction of the harmonization section by multiplying the weighting coefficients corresponding to all types of instruments being played, for example. Then, the harmonization section extracting unit 104 extracts the harmonization section based on the calculated weighting coefficient. In addition, the method of setting the weighting coefficient described herein is one example, and the setting of the weighting coefficient may be configured to be adjustable in accordance with the system conditions and the user operation of the musical composition reproducing apparatus 100. For example, setting may be made such that the weighting coefficient is temporally changed by adjusting the weighting coefficient such that the piano sound is the main sound in the first half of the remixed musical composition while the guitar sound is the main sound in the second half thereof.

(Supplementary Explanation 3 Regarding Weighting Coefficient: Example of Weighting in Accordance with Position in Lyrics)

Figures 17, 18:
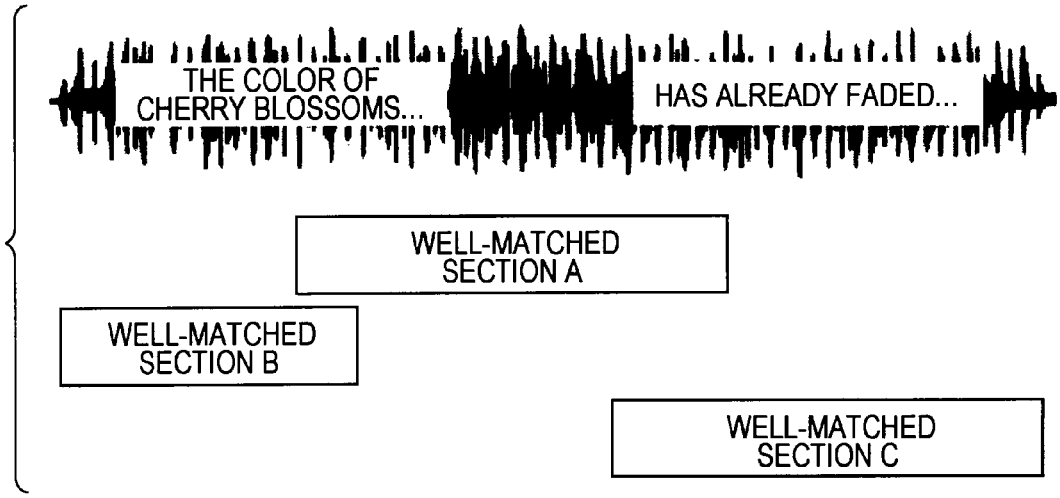
FIG. 17 is an explanatory diagram for illustrating an example of weighting used in a harmonization section extracting method according to the embodiment.
FIG. 18 is an explanatory diagram for illustrating an example of weighting used in a harmonization section extracting method according to the embodiment.

Description will be given of a method of setting a weighting coefficient in accordance with the lyric information included in the metadata D2 with reference to FIGS. 17 and 18. FIGS. 17 and 18 are explanatory diagrams for illustrating a method of setting a weighting coefficient in accordance with the position in the lyrics.

If the joining part of the harmonization section is at the midstream of the lyrics, a word in the lyrics is interrupted in the case of a musical composition including vocal. Therefore, a small weighting coefficient is set to the harmonization section in which the lyrics are interrupted at its midstream in consideration of the relationship between the start and end positions of the harmonization section and the position in the lyrics. For example, the lyrics are interrupted at the start position and the end position of the harmonization section A in the example of FIG. 17. In addition, the lyrics are interrupted at the end position of the harmonization section B. On the other hand, the lyrics are not interrupted at the start position and the end position of the harmonization section C.

If the weighting coefficient in the case of one interruption in the lyrics is set to 0.8, the weighting coefficient in the case of two interruptions in the lyrics is set to 0.64 (=0.8×0.8), and the weighting coefficient in the case of no interruption in the lyrics is set to 1.0, the weighting coefficients are set as shown in FIG. 18. In addition, the method of setting the weighting coefficient described herein is one example, and setting of the weighting coefficient may be configured to be adjustable in accordance with the system conditions or the user operation of the musical composition reproducing apparatus 100.

(Supplementary Explanation 4 Regarding Weighting Coefficient: Example of Weighting in Accordance with Mood of Musical composition)

Next, description will be given of a method of setting a weighting coefficient in accordance with the mood of the musical composition. In addition, a value or a label (such as "happy", "healing" or the like) indicating mood of a musical composition may be included in the metadata D2. When mood of a musical composition is expressed with a value or a label, a distance or a similarity between the mood of the musical compositions may be listed in advance, and the relation between the weighting coefficient and the mood of the musical composition may be set such that the weighting coefficient becomes smaller when the distance is greater or when the similarity is lower.

For example, when the user sets mood of the remixed musical composition, the distance between the set mood and the mood of each musical composition is compared, and the weighting coefficient is set to 1.0 for the same mood and set so as to approach 0.0 when the difference in mood (distance between mood) becomes greater, for different mood.

In addition, when mood of a musical composition is expressed not with one representative value (numerical value) or a label but as a group (vector) of a plurality of parameter values, a similarity between two vectors is obtained, and a normalized weighting coefficient is set such that a weighting coefficient when the two vectors are completely same is set to 1.0 while a weighting coefficient when the two vectors are completely different is set to 0.0. In addition, as a method of obtaining a similarity between two vectors, there is a method of using a vector space model, a cosine similarity, or the like.

(Supplementary Explanation 5 Regarding Weighting Coefficient: Example of Weighting in Accordance with Category of Musical Composition)

Next, description will be given of a method of setting a weighting coefficient in accordance with a category of a musical composition. Generally, one category is associated with one musical composition. Therefore, one label indicating a category is provided to each musical composition. Accordingly, distances (similarity) between categories are set in advance for all prepared categories, and a weighting coefficient is set based on the distance between the target category and the category of the musical composition corresponding to the harmonization section, when a weighting coefficient is set. For example, setting is made such that a weighting coefficient becomes small when the distance between categories is long.

Specific examples were introduced as method of setting a weighting coefficient. The weighting setting methods described in the supplementary explanations 1 to 5 regarding a weighting coefficient can be used respectively or in combination. In such a case, a weighting coefficient obtained with the use of each method is multiplied, and the multiplication result is used for the extraction of the harmonization section. As described above, the harmonization section extracting unit 104 can perform various weighting on the harmonization level of each harmonization section with the use of the metadata D2. By performing such weighting, it is possible to reduce the interruption of the lyrics at the start or end position of the harmonization section, reduce the joining of harmonization sections with different melody types, instrument types, or mood or in different categories, and thereby to obtain a remixed musical composition causing less sense of discomfort at the connections.

The above description has been given of the configuration of the musical composition reproducing apparatus 100 according to this embodiment. By applying this configuration, it is possible to reproduce a remixed musical composition which has been remixed in a further seamless manner. In addition, it is possible to further reduce the sense of discomfort to be given to the user at the connections of musical compositions.

2: Hardware Configuration Example

Figure 19:
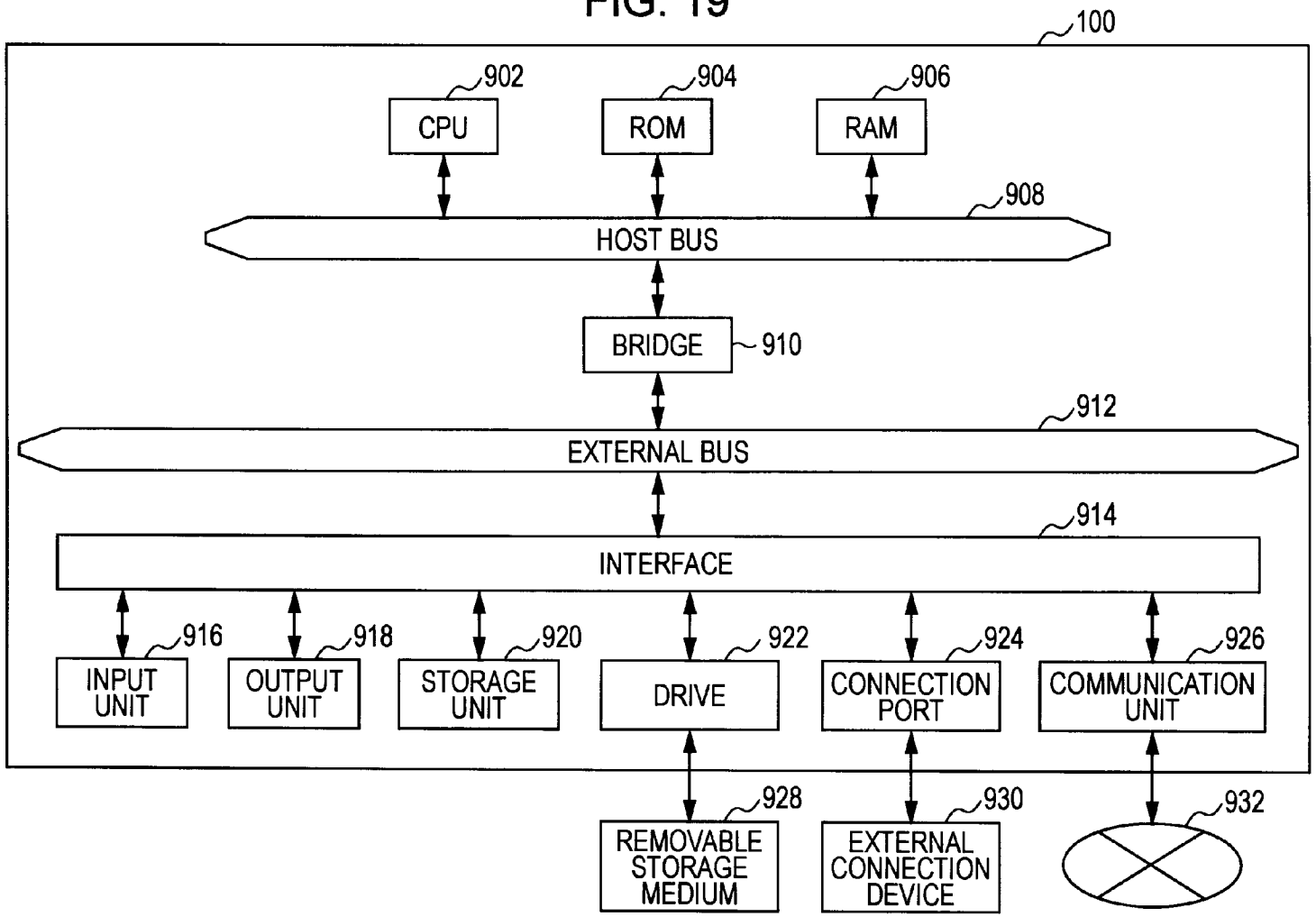
FIG. 19 is an explanatory diagram for illustrating a hardware configuration of an information processing apparatus capable of realizing functions of a musical composition reproducing apparatus according to the embodiment.

The functions of each component included in the musical composition reproducing apparatus 100 can be realized with the use of a hardware configuration of an information processing apparatus shown in FIG. 19, for example. That is, the functions of each component are realized by controlling the hardware shown in FIG. 19 with the use of a computer program. In addition, the hardware can be arbitrarily configured, and a mobile information terminal such as a personal computer, a mobile phone, a PHS, a PDA, and the like, a game machine or various information appliances are included therein. Here, the above PHS is an abbreviation of Personal Handy-phone System. In addition, the above PDA is an abbreviation of Personal Digital Assistant.

As shown in FIG. 19, this hardware mainly includes a CPU 902, a ROM 904, a RAM 906, a host bus 908, and a bridge 910. Furthermore, this hardware includes an external bus 912, an interface 914, an input unit 916, an output unit 918, a storage unit 920, a drive 922, a connection port 924, and a communication unit 926. Here, the above CPU is an abbreviation of Central Processing Unit. In addition, the above ROM is an abbreviation of Read Only Memory. Moreover, the above RAM is an abbreviation of Random Access Memory.

The CPU 902 functions as a computation processing apparatus or a control apparatus and controls overall or partial operations of each components based on various programs stored on the ROM 904, the RAM 906, the storage unit 920, or a removable recording medium 928. The ROM 904 is for storing data and the like to be used for a program read by the CPU 902 or computation. The RAM 906 temporarily or permanently stores a program to be read by the CPU 902, various parameters which are appropriately changed when the program is executed, and the like.

Such components are connected to each other via the host bus 908 capable of performing high-speed data transmission, for example. On the other hand, the host bus 908 is connected to an external bus 912 with a relatively slow data transmission speed via the bridge 910. In addition, a mouse, a keyboard, a touch panel, a button, a switch, a lever, and the like are used as the input unit 916, for example. Furthermore, a remote controller (hereinafter, referred to as a remote control) capable of transmitting a control signal with the use of an infrared ray or another radio wave is used as the input unit 916 in some cases.

The output unit 918 is an apparatus, which can visually or acoustically notifies a user of obtained information, such as a display apparatus including a CRT, an LCD, a PDP, an ELD, or the like, an audio output apparatus including a speaker, a headset, or the like, a printer, a mobile phone, a facsimile, or the like. Here, the above CRT is an abbreviation of Cathode Ray Tube. In addition, the above LCD is an abbreviation of Liquid Crystal Display. Moreover, the above PDP is an abbreviation of Plasma Display Panel. Furthermore, the above ELD is an abbreviation of Electro-Luminescence Display.

The storage unit 920 is an apparatus for storing various kinds of data. As the storage unit 920, a magnetic storage device such as a hard disk drive (HDD) or the like, a semiconductor storage device, an optical storage device, a magnetooptical storage device, or the like is used. Here, the above HDD is an abbreviation of Hard Disk Drive.

The drive 922 is an apparatus which reads the information stored on a removable storage medium 928 such as a magnetic disk, an optical disk, a magnetooptical disk, a semiconductor disk, or the like and writes information on the removable storage medium 928. The removable storage medium 928 is a DVD medium, a Blu-ray medium, an HD DVD medium, various semiconductor storage media, or the like, for example. It is matter of course that the removable storage medium 928 may be an IC card mounting a non-contact type IC chip, an electronic device, or the like, for example. Here, the above IC is an abbreviation of Integrated Circuit.

The connection port 924 is a port which connects an external connection device 930 such as a USB port, an IEEE1394 port, an SCSI, an RS-232C port, an optical audio terminal, or the like. The external connection device 930 is a printer, a mobile music player, a digital camera, a digital video camera, an IC recorder, or the like, for example. Here, the above USB is an abbreviation of Universal Serial Bus. In addition, the above SCSI is an abbreviation of Small Computer System Interface.

The communication unit 926 is a communication device which is connected to the network 932, and is a wired or wireless LAN, Bluetooth (registered trademark), a communication card for WUSB, a router for optical communication, a router for ADSL, a modem for various kinds of communication, or the like, for example. The network 932 to which the communication unit 926 connects is configured by network connected in a wired or wireless manner, and is the Internet, LAN for one's home, infrared communication, visible light communication, broadcasting, satellite communication, or the like for example. Here, the above LAN is an abbreviation of Local Area Network. In addition, the above WUSB is an abbreviation of Wireless USB. Moreover, the above ADSL is an abbreviation of Asymmetric Digital Subscriber Line.

3: Conclusions

Finally, conclusions regarding the technical content according to the exemplary embodiment will be briefly described. The technical contents described herein can be applied to various information processing apparatuses such as a PC, a mobile phone, a mobile game machine, a mobile information terminal, an information appliance, a car navigation system, and the like, for example.

The functional configuration of the above information processing apparatus can be expressed as follows, for example. The information processing apparatus includes a musical composition extracting unit, a harmonization level calculation unit, and a harmonization section extracting unit, which will be described later. The musical composition section extracting unit is for extracting musical composition sections with tempos which are close to a preset reference tempo based on tempo information indicating a tempo of each section constituting musical compositions. In addition, the musical composition section extracting unit may extract a plurality of sections from one musical composition. The musical composition extracted here has a tempo which is close to the reference tempo. Therefore, the melody of the musical composition is not greatly changed, and a sense of discomfort is hardly given to a user who listens to the musical composition, even if the extracted musical composition is reproduced at the reference tempo.

In addition, the harmonization level calculation unit is for calculating a harmonization degree for a pair of musical composition sections extracted by the musical composition section extracting unit based on chord progression information indicating chord progression of each section constituting the musical compositions. Since chord progression synchronizes with each other when two musical compositions with the same absolute chord progression are mixed and reproduced, no discordance is generated even when the two musical compositions are mixed and reproduced. In addition, if one musical composition is modulated and reproduced such that keys thereof synchronize with each other when two musical compositions with the same relative chord progression are mixed and reproduced, no discordance is generated when the two musical compositions are mixed and reproduced. Moreover, if two musical compositions are mixed and reproduced when chord progression of one musical composition is substitution chord of the other musical composition, discordance is hardly generated. In addition, even if the reference tempo is changed in a time-series manner, a musical composition section suitable for the reference tempo at each time point is automatically extracted. That is, the change in the reference tempo changes not only the tempo of the remixed musical composition but also the musical composition itself to be extracted.

Thus, the harmonization level calculation unit calculates an evaluation value of the harmonization degree between musical compositions with the use of the chord progression information in order to extract two musical compositions which hardly generate discordance when mixed and reproduced. Particularly, the harmonization degree calculating unit calculates an evaluation value of the harmonization degree between musical compositions (between sections) for sections which are extracted from the musical compositions in minimum units of beats. With such a configuration, the information processing apparatus can quantitatively evaluate the harmonization degree between musical compositions in units of musical composition sections. Thus, the harmonization section extracting unit refers to the evaluation value of the harmonization degree calculated by the harmonization degree calculating unit and extracts a pair of sections with a high harmonization degrees of musical compositions, which have been calculated by the harmonization degree calculating unit, from among the sections extracted by the musical composition section extracting unit.

The pair of sections extracted by the harmonization section extracting unit is a combination between musical composition sections from which discordance is hardly generated when the musical compositions are mixed and reproduced. In addition, the two musical composition sections are musical composition sections which do not give a user a sense of discomfort even when reproduced at the reference tempo. Accordingly, the melody of each musical composition is not greatly changed, and ideal mixing and reproducing at a uniform tempo, which hardly generate discordance, can be realized, when the tempos of such musical composition sections are adjusted to the reference tempo and the musical composition sections are mixed and reproduced while the beat positions thereof are made to synchronize with each other. In addition, the harmonization degree calculating unit may weight the harmonization degree for the musical composition such that a large value is set to the harmonization degree between musical compositions with a predetermined relationship. With such a configuration, it is possible to prevent musical composition sections with completely different melodies or in completely different categories from being mixed and reproduced. In addition, it is possible to mix only musical composition in accordance with the user preference by designating the predetermined relationship by the user.

(Remarks)

The target musical composition section extracting unit 103 is an example of the musical composition section extracting unit. The harmonization section extracting unit 104 is an example of the harmonization level calculating unit and the harmonization section extracting unit. The parameter setting unit 102 is one example of the tempo setting unit. The acceleration sensor 110 is an example of the rhythm detection unit. The mixing reproducing unit 105 is one example of the tempo adjustment unit and the musical composition reproducing unit. The harmonization section extracting unit 104 is an example of the modulation step calculation unit.

Although the above description has been given of a preferable exemplary embodiment with reference to the accompanying drawings, it is needless to say that the present disclosure is not limited to such an example. It should be understood by those skilled in the art that carious changes or modifications can be made within the scope of the appended claims and such changes and modifications are also within the technical scope of the present disclosure.

The present disclosure contains subject matter related to that disclosed in Japanese Priority Patent Application JP 2010-253914 filed in the Japan Patent Office on Nov. 12, 2010, the entire contents of which are hereby incorporated by reference.

What is claimed is:

1. An information processing apparatus comprising:

a musical composition section extracting unit which extracts musical composition sections with tempos which are close to a preset reference tempo based on tempo information indicating a tempo of each section constituting musical compositions;

a harmonization level calculating unit which calculates a harmonization degree for a pair of musical composition sections extracted by the musical composition section extracting unit, based on chord progression information indicating chord progression of each section constituting musical compositions; and a harmonization section extracting unit which extracts a pair of sections with a high harmonization degree for the musical compositions calculated by the harmonization level calculating unit from among sections extracted by the musical composition section extracting unit, wherein the harmonization level calculating unit weights the harmonization degree for the musical compositions such that a large value is set to the harmonization degree between musical compositions with a predetermined relationship.

2. The information processing apparatus according to claim 1, further comprising:

a tempo setting unit which sets the reference tempo, wherein the tempo setting unit changes the reference tempo based on a predetermined time-series data.

3. The information processing apparatus according to claim 1, further comprising:

a rhythm detection unit which detects a user's exercise rhythm; and a tempo setting unit which sets the reference tempo, wherein the tempo setting unit changes the reference tempo so as to match the user's exercise rhythm detected by the rhythm detection unit.

4. The information processing unit according to claim 1, wherein the harmonization level calculating unit weights the harmonization degrees of musical compositions such that a large value is set to the harmonization levels between musical compositions to both of which metadata indicating one or a plurality of preset mood, categories, melody structures, and instrument types of the musical compositions has been added.

5. The information processing apparatus according to claim 1, wherein the harmonization section extracting unit extracts a pair of sections, in which phrases of lyrics are not interrupted at ends, with priority from among the sections extracted by the musical composition section extracting unit.

6. The information processing apparatus according to claim 1, wherein the musical composition section extracting unit further extracts a section of an eight-beat musical composition with a tempo which corresponds to about ½ of the reference tempo and a section of a sixteen-beat musical composition with a tempo which corresponds to about ½ or ¼ of the reference tempo.

7. The information processing apparatus according to claim 1, further comprising:

a tempo adjustment unit which adjusts tempos of two musical compositions corresponding to a pair of sections extracted by the harmonization section extracting unit to the reference tempo; and a musical composition reproducing unit which makes beat positions synchronize with each other after tempo adjustment by the tempo adjustment unit and reproduces the two musical compositions corresponding to the pair of sections extracted by the harmonization section extracting unit simultaneously.

8. The information processing apparatus according to claim 6, further comprising:

a modulation step calculation unit which calculates modulation steps by which keys of two musical compositions corresponding to the pair of sections extracted by the harmonization section extracting unit are made to match, wherein the harmonization level calculating unit calculates the harmonization level of musical compositions based on chord progression information of absolute chord and chord progression information of relative chord, wherein the harmonization section extracting unit extracts a pair of sections with a high harmonization degree for the musical compositions calculated by the harmonization level calculating unit based on the chord progression information of the relative chord or a pair of sections with a high harmonization degree for the musical compositions calculated by the harmonization level calculating unit based on the chord progression information of the absolute chord, and wherein the musical composition reproducing unit reproduces a musical composition which has been modulated by the modulation steps calculated by the modulation step calculating unit.

9. The information processing apparatus according to claim 6, wherein the musical composition reproducing unit crossfades and reproduces the two musical compositions.

10. The information processing apparatus according to claim 8, wherein the music reproducing unit sets the time of crossfade to be shorter when the harmonization degree for the musical compositions calculated by the harmonization level calculating unit is lower.

11. An information processing apparatus comprising:

a musical composition section extracting unit which extracts musical composition sections with tempos which are close to a predetermined reference tempo, which temporally changes, based on tempo information indicating a tempo of each section constituting musical compositions;

a harmonization level calculating unit which calculates a harmonization degree for a pair of musical composition sections extracted by the musical composition section extracting unit, based on chord progression information indicating chord progression of each section constituting musical compositions; and a harmonization section extracting unit which extracts a pair of sections with a high harmonization degree for the musical compositions calculated by the harmonization level calculating unit from among sections extracted by the musical composition section extracting unit.

12. A musical composition section extracting method comprising:

extracting music sections with tempos which are close to a preset reference tempo based on tempo information indicating a tempo of each section constituting musical compositions;

calculating a harmonization degree for a pair of musical composition sections extracted in the extracting, based on chord progression information indicating chord progression of each section constituting musical compositions; and extracting a pair of sections with a high harmonization degree for the musical compositions calculated in the calculating from among sections extracted in the previous extracting, wherein in the calculating, the harmonization degree for the musical compositions is weighted such that a large value is set to the harmonization degree between musical compositions with a predetermined relationship.

13. A musical composition section extracting method comprising:

extracting musical composition sections with tempos which are close to a predetermined reference tempo, which temporally changes, based on tempo information indicating a tempo of each section constituting musical compositions;

calculating a harmonization degree for a pair of musical composition sections extracted in the extracting, based on chord progression information indicating chord progression of each section constituting musical compositions; and extracting a pair of sections with a high harmonization degree for the musical compositions calculated in the calculating from among sections extracted in the previous extracting.

14. A program which causes a computer to realize:

a musical composition section extracting function which extracts musical composition sections with tempos which are close to a preset reference tempo based on tempo information indicating a tempo of each section constituting musical compositions;

a harmonization level calculating function which calculates a harmonization degree for a pair of musical composition sections extracted by the musical composition section extracting function, based on chord progression information indicating chord progression of each section constituting musical compositions; and a harmonization section extracting function which extracts a pair of sections with a high harmonization degree for the musical compositions calculated by the harmonization level calculating function from among sections extracted by the musical composition section extracting function, wherein the harmonization level calculating function weights the harmonization degree for the musical compositions such that a large value is set to the harmonization degree between musical compositions with a predetermined relationship.

15. A program which causes a computer to realize:

a musical composition section extracting function which extracts musical composition sections with tempos which are close to a predetermined reference tempo, which temporally changes, based on tempo information indicating a tempo of each section constituting musical compositions;

a harmonization level calculating function which calculates a harmonization degree for a pair of musical composition sections extracted by the musical composition section extracting function, based on chord progression information indicating chord progression of each section constituting musical compositions; and a harmonization section extracting function which extracts a pair of sections with a high harmonization degree for the musical compositions calculated by the harmonization level calculating function from among sections extracted by the musical composition section extracting function.

* * * * *